US008925236B1

(12) United States Patent
Mayberry et al.

(10) Patent No.: US 8,925,236 B1
(45) Date of Patent: Jan. 6, 2015

(54) FIREARM ACCESSORY MOUNTING INTERFACE

(71) Applicant: Magpul Industries Corp, Boulder, CO (US)

(72) Inventors: Michael T. Mayberry, Denver, CO (US); William Bradley Bennett, Lafayette, CO (US); Timothy Eric Roberts, Erie, CO (US); Duane Liptak, Erie, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 14/271,912

(22) Filed: May 7, 2014

Related U.S. Application Data

(60) Provisional application No. 61/974,968, filed on Apr. 3, 2014.

(51) Int. Cl.
*F41C 27/00* (2006.01)
*F41G 11/00* (2006.01)
*F41G 1/387* (2006.01)

(52) U.S. Cl.
CPC ..... *F41C 27/00* (2013.01); *F41G 11/005* (2013.01); *F41G 11/004* (2013.01); *F41G 1/387* (2013.01)
USPC ..... 42/124

(58) Field of Classification Search
None
See application file for complete search history.

(56) References Cited

U.S. PATENT DOCUMENTS

| | | | | |
|---|---|---|---|---|
| 2,642,689 | A | 7/1953 | Cline | |
| 3,226,872 | A | 5/1964 | Pachmayr | |
| 3,265,416 | A | 8/1966 | Downes | |
| 4,959,908 | A * | 10/1990 | Weyrauch | 42/124 |
| 5,375,361 | A * | 12/1994 | Rustick | 42/125 |
| 5,603,594 | A * | 2/1997 | Lincoln | 411/84 |
| 7,430,829 | B2 | 10/2008 | Murello | |
| 8,453,402 | B2 | 6/2013 | Huang | |
| 2011/0000146 | A1 | 1/2011 | Takeda et al. | |
| 2012/0097807 | A1 | 4/2012 | Rees | |

FOREIGN PATENT DOCUMENTS

DE 102006011569 * 9/2007

OTHER PUBLICATIONS

Aircraft Spruce & Specialty Co., "Camloc", webpage found at http://www.aircraftspruce.com/menus/ha/fast_1 camloc.html downloaded on Sep. 26, 2014, pp. 2.

Southco, "DZUS Push-To-Close, Turhn-To-Open Quarter Fasteners", webpage found at http://www.southco.com/en-us/product/hierarchy.html?hid=7345 downloaded on Sep. 26, 2014, pp. 2.

McMaster-Carr, "Strut Channel", webpage found at http://www.mcmaster.com/%23strut-channel-systems/=tvreqm downloaded on Sep. 26, 2014, pp. 7.

(Continued)

*Primary Examiner* — Stephen M Johnson
(74) *Attorney, Agent, or Firm* — Neugeboren O'Dowd PC

(57) ABSTRACT

An improved firearm accessory mounting interface is herein disclosed. The interface can include one or more sets of first and second fasteners that interface through an elongated slot in a firearm in order to mount a firearm accessory to a firearm. The second fastener can be shaped and sized to clear the elongated slot and can, upon clearing the elongated slot, be pivoted to an oblique orientation relative to the elongated slot so that the second fastener cannot be retracted. The first fastener can continue to be turned thus drawing the first and second fasteners toward each other and locking the accessory to the firearm.

25 Claims, 54 Drawing Sheets

(56) References Cited

OTHER PUBLICATIONS

Global Industrial, "80/20 3932 Drop-In T-Nuts", webpage found at http://www.globalindustrial.com/p/building-materials/struts-and-framing/8020/3932-dropin-tnuts?infoParam.campaignId=T9F&gclid=CKiwqoe-__cACFSMLMgodkBUA5A&gclsrc=aw.ds downloaded on Sep. 26, 2014, pp. 2.

McMaster-Carr, "Quick-Access Captive Panel Screws", webpage found at http://www.mcmaster.com/%23quarter-turn-fasteners/=tvra7i downloaded on Sep. 26, 2014, pp. 4.

* cited by examiner

FIREARM ACCESSORY MOUNTING INTERFACE

PRIORITY

The present application claims priority under 35 U.S.C. 119(e) to U.S. Provisional Patent Application No. 61/974,968, entitled, "FIREARM ACCESSORY MOUNTING INTERFACE," and filed Apr. 3, 2014, the entirety of which is incorporated herein by reference.

FIELD OF THE DISCLOSURE

The present invention relates to the field of firearms and more particularly relates to an improved firearm accessory mounting interface.

BACKGROUND

Modern firearms, in particular, military assault rifles, can be deployed for a number of combat missions such as sniper weapons and in close combat. They are commonly used for nighttime combat. All of these applications can require fitting a variety of telescopic sights, infrared sights, tactical lights, laser sighting modules, grenade launchers, bipods, grips and other accessories to the firearm. For mounting purposes, standardized mounting platforms have been developed, such as the Picatinny rail platform (MIL-STD-1913 or STANAG 2324). The Picatinny rail is a cross-section shaped roughly like a wide T with the top of the T corresponding to the top of the rail. The rail has a number of evenly spaced transverse slots in the top spanning the width of the T-shaped cross-section.

Such rails are often placed directly on the weapon's receiver, in the position normally occupied by the rear sights. The rail may also extend over the rifle handguard associated with the rifle barrel. In addition to top mounting rails, firearms may now include rails fastened to guns in various locations. In some cases, grips are surrounded with top, bottom and side rails. Mounting rails are also appearing on shotguns and pistols.

While the mounting rails have obvious utilitarian benefits, they are not without some shortcomings. Most notably, they can be uncomfortable when grasped by a user's hands, they can snag on clothing, barbed wire, and other objects, they add weight to a weapon system, and under certain field conditions they may become clogged with dirt and other debris that make it difficult to install one of the many accessories receivable on the rails.

Other systems have detachable rails that allow the user to install rails only where they are needed, and only of the length needed. While this decreases weight (and the discomfort and other disadvantages) of having needless rails where the hand is to grip, it suffers from other disadvantages. First, such systems may be difficult or complex to install. Second, they may require custom modification of parts, such as drilling and tapping holes where needed. Third, the attachment locations may be in limited locations due to the need to relocate fasteners such as threaded inserts (or may increase cost and weight by using an excessive number of fasteners).

A further significant disadvantage of systems having modular rails that may be mounted in various locations on the forearm or handguard of a rifle stock is the susceptibility to loosening. If the mount for a rifle scope becomes loose, this can cause significant aiming errors.

One solution to the disadvantages of Picatinny rail systems is the KEYMOD system introduced by VLTOR Weapon Systems. The KEYMOD system consists of two parts: the KEYMOD slot; and the KEYMOD nut. The slot is distinctive with a larger diameter through-hole combined with a narrow slot. The slot is chamfered on the backside while the through-hole is sized for clearance of a quick-detach sling swivel (approximately ⅜" diameter).

However, the KEYMOD specifications also suffer from several disadvantages including more complex manufacturing. The KEYMOD specification is also harder to implement in polymeric materials since it typically requires complex secondary machining operations rather than standard molding processes to form the keyhole apertures. Therefore, there is a need in the art for a firearm accessory mounting interface that adds minimal or no weight to a weapon system, is unlikely to snag, is unlikely to clog with mud and debris, and is comfortable to hold.

SUMMARY OF THE DISCLOSURE

In view of the foregoing disadvantages inherent in the known types of accessory interfaces, this disclosure provides an improved firearm accessory mounting interface. As such, the present disclosure's general purpose is to provide a new and improved accessory mounting interface that is easy to use, adds minimal or no weight to a weapon system, is unlikely to snag, is unlikely to clog with mud and debris, and is comfortable to hold. The process of making the improved firearm accessory mounting interface is also faster, easier to adapt to polymeric material processes, and results in greater part consistency than the prior art accessory mounting interfaces.

To accomplish these objectives, the improved firearm accessory mounting interface comprises three parts: a first elongated fastener (e.g., a screw), a second fastener (e.g., a nut), and an elongated slot. The elongated slot is sized to allow clearance of the second fastener when in an "open" position and to prevent clearance once the second fastener has passed through the elongated slot and is turned to a "closed" or "locked" position. The closed or locked position can be oblique to the open position, and preferably includes angles between 45° and 135° to the open position. In another preferred embodiment, the locked position can be oriented 90° to the closed position. The first elongated fastener can be turned, which in turn causes the second fastener to rotate from the open to the closed position, thereby locking the second fastener. The first elongated fastener can continue to be rotated, bringing the first elongated fastener and the second fastener closer together thereby pinching or squeezing the firearm therebetween and locking the firearm accessory to the firearm.

One aspect of the disclosure can be characterized as an accessory mounting interface for a firearm comprising a firearm accessory, a first elongated fastener, a second fastener, and an elongated slot in a firearm. The firearm accessory can have at least one through-hole extending from a first surface to a second surface of the firearm accessory. The first elongated fastener can be removably engaged in the through hole and have a first end extending below the second surface of the firearm accessory. The second fastener can be rotationally mated to the first end of the first elongated fastener and have a length greater than its width, the length being measured along a longitudinal axis of the second fastener. The second fastener can comprise at least two straight edges parallel to each other and at least one curved portion separating the two straight edges. The elongated slot can have a length that is greater than its width. The width of the elongated slot can be greater than the width of the second fastener but less than the length of the second fastener. As such, the second fastener can pass through the elongated slot when a longitudinal axis of the second fastener is arranged parallel to a longitudinal axis of the elongated slot, but cannot pass through the elongated slot when the longitudinal axis of the second fastener is arranged obliquely to the longitudinal axis of the elongated slot. At least one of the two straight edges preventing the second fastener from rotating beyond a closed position once the second fastener has passed through and cleared the elongated slot.

Another aspect of the disclosure can also be characterized as a method of mating a firearm accessory to a firearm having an accessory mounting interface. The method can include providing a firearm accessory having a through hole, and providing a first elongated fastener removably engaged in the through hole and having a threaded region and a flanged end. The method can further include providing a second fastener and mating the second fastener to the threaded region of the first elongated fastener. The method can further include providing an elongated slot in a wall of a firearm and orienting a longitudinal axis of the second fastener parallel to a longitudinal axis of the elongated slot. Further, the method can include passing the second fastener through the elongated slot with a longitudinal axis of the second fastener parallel to the longitudinal axis of the elongated slot. Finally, the method can include rotating the first elongated fastener, which in turn rotates the second fastener, once the second fastener is clear of the elongated slot. As such, the longitudinal axis of the second fastener rotates to an oblique orientation of between 45° to 135° relative to the longitudinal axis of the elongated slot and cannot rotate further. The rotating can continue after the second fastener cannot rotate further, thereby drawing the flanged end of the first elongated fastener closer to the second fastener and preventing the second fastener from passing back through the elongated slot and also securing the firearm accessory to the firearm.

Yet another aspect of the disclosure can be characterized as a firearm accessory mounting interface comprising an elongated slot in a handguard of the firearm, a first cammed fastener, and a second cammed fastener. The first cammed fastener can have a length sufficient to pass through the firearm accessory and clear a depth of a wall of the handguard along with a flanged head to press the firearm accessory against an outside of the handguard. The second cammed fastener can have a length greater than a width and can be mated to the first cammed fastener and oriented so as to have a longitudinal axis parallel to a longitudinal axis of the elongated slot when inserted into and passed through the elongated slot and rotated 45° to 135°. This rotation prevents removal of the second cammed fastener from the elongated slot while the first cammed fastener is rotated such that the second cammed fastener and the flanged head of the first cammed fastener are drawn together thereby locking the firearm accessory to the handguard. The second cammed fastener can have at least two parallel straight edges, one of the at least two parallel straight edges preventing the cammed fastener from rotating more than 45° to 135° clockwise or counterclockwise.

The more important features of the disclosure have thus been outlined in order that the more detailed description that follows may be better understood and in order that the present contribution to the art may better be appreciated. Additional features of the disclosure will be described hereinafter and will form the subject matter of the claims that follow.

Many objects of this disclosure will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

With reference now to the drawings, the preferred embodiment of the firearm accessory mounting interface is herein described. It should be noted that the articles "a", "an" and "the", as used in this specification, include plural referents unless the content clearly dictates otherwise.

The improved firearm accessory mounting interface comprises three parts: a first elongated fastener (e.g., a screw or first cammed fastener), second fastener (e.g., a nut or a second cammed fastener), and an elongated slot. Embodiments of the entire interface as used on handguards can be seen in FIGS. 1-6. Embodiments of the interface as used on a portion of a firearm can be seen in FIGS. 7-14B. Embodiments of the second fastener can be seen in FIGS. 15-19, and 23-51. Embodiments of the first elongated fastener and the second fastener can be seen in FIG. 28. Embodiments of the elongated slot as used in a handguard can be seen in FIGS. 1-6 and 20-21. Embodiments of a firearm accessory adapted for use with the improved firearm accessory mounting interface can be seen in FIGS. 1-14 and 22-23B.

FIGS. 1-6 show embodiments of portions of firearms having accessories mounted thereto via embodiments of the firearm accessory mounting interface described herein (e.g., at least one elongated fastener, at least one fastener, and at least one elongated slot).

Figure 1:
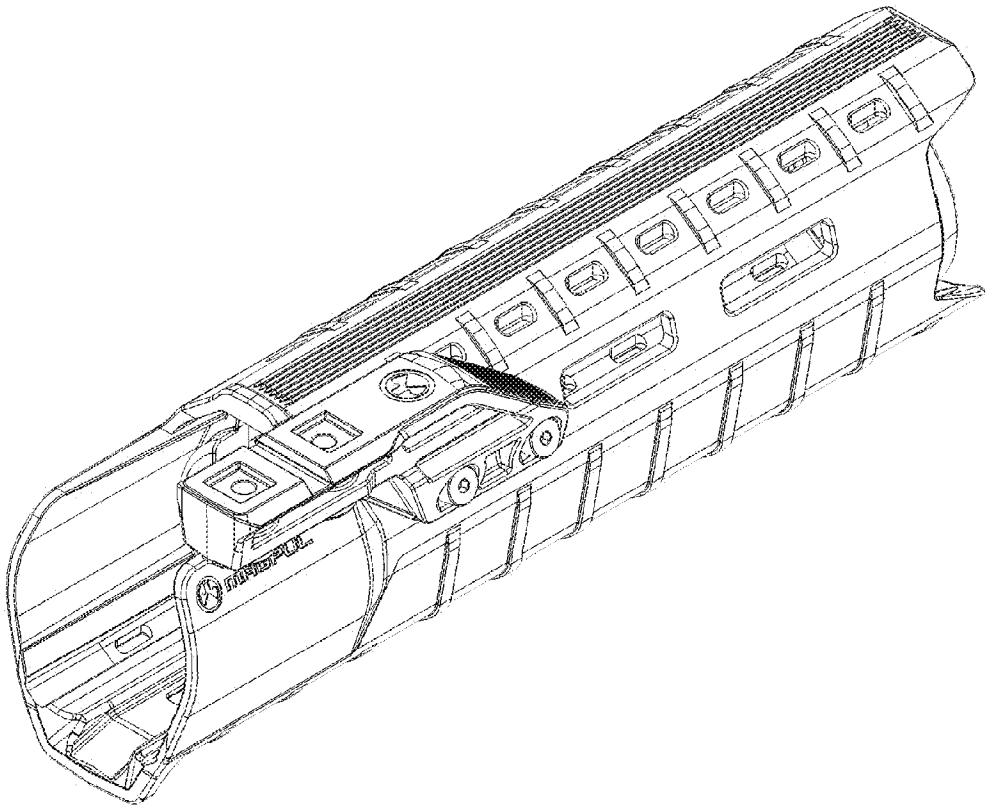
FIG. 1 is a perspective view of a handguard of a firearm removably coupled to a firearm accessory via an embodiment of a firearm accessory interface of this disclosure.
Figure 2:
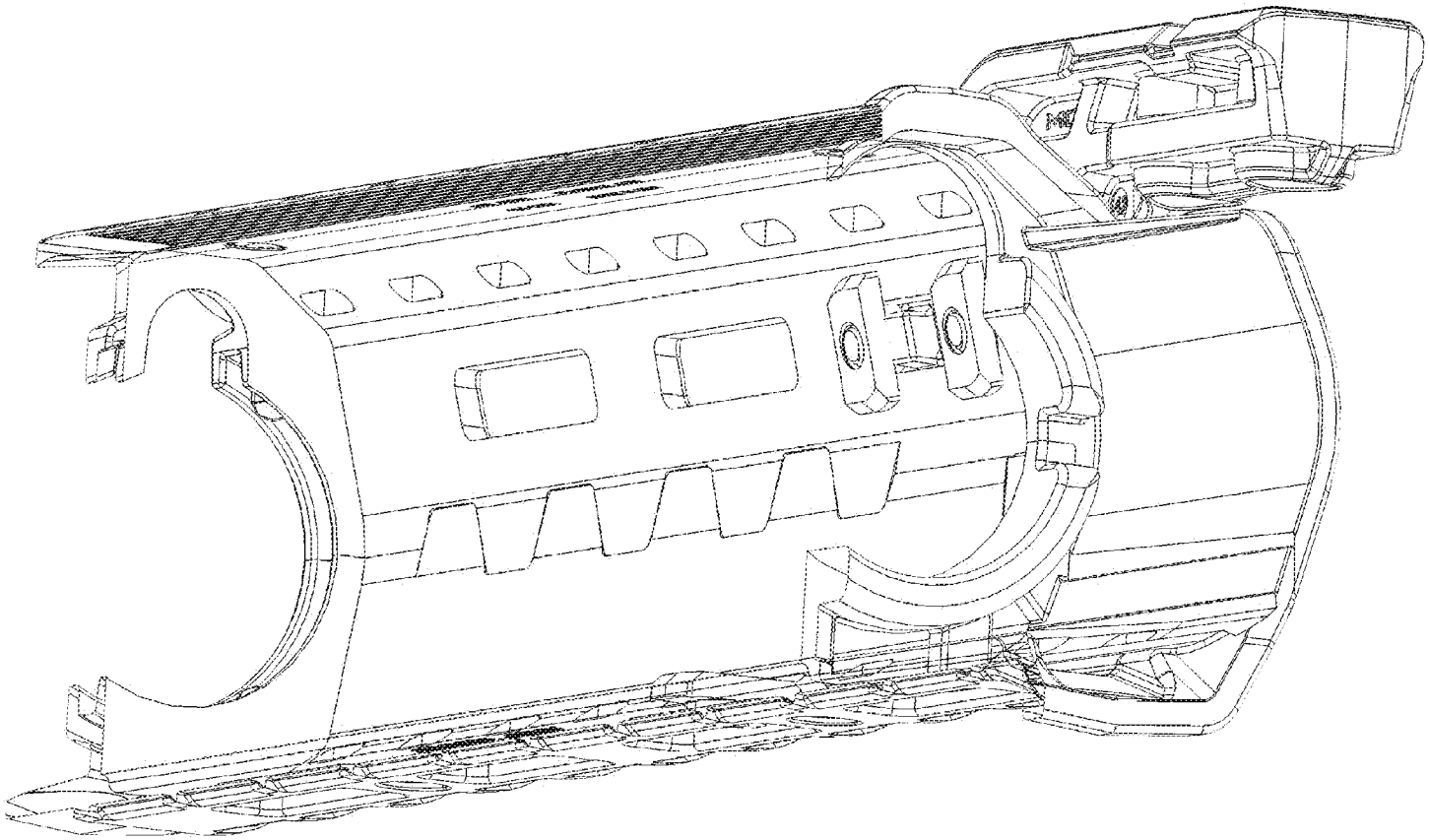
FIG. 2 is a cutaway view of a handguard of a firearm removably coupled to a firearm accessory via an embodiment of a firearm accessory interface of this disclosure.
Figure 3:
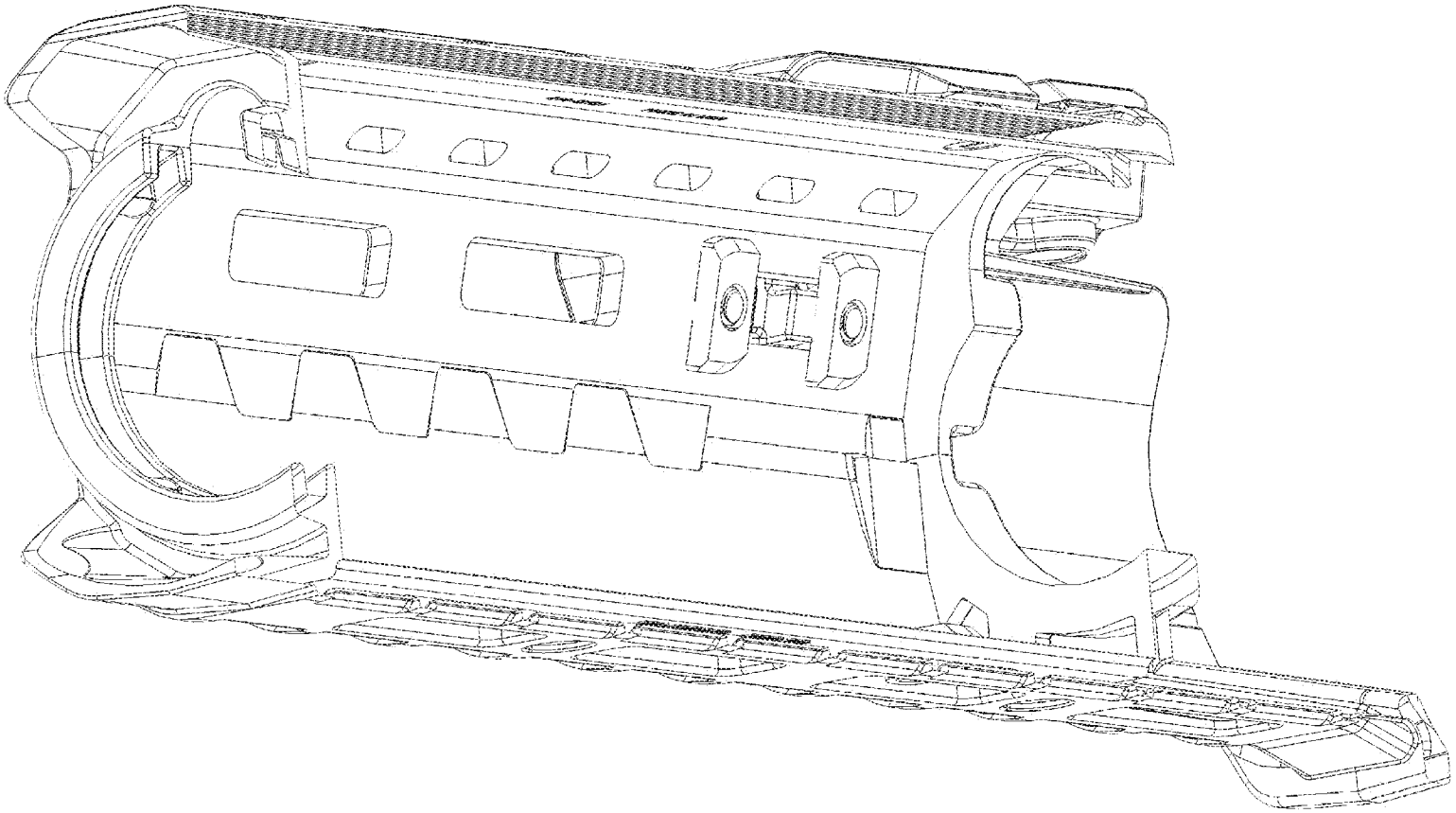
FIG. 3 is another cutaway view of a portion of the firearm illustrated in FIGS. 1 and 2.

FIGS. 1-3 show a light mount affixed to a side of a handguard via an embodiment of the firearm accessory mounting interface. Here the accessory mounting interface includes one of three elongated slots on a left side of a handguard as well as a pair of first elongated fasteners (e.g., screws) and second fasteners (e.g., nuts) that couple the light mount to the elongated slot. In FIGS. 2-3 the second fasteners can be seen in a "locked" position, or turned 90° to a position where the second fasteners can clear the elongated slot (or have a length parallel to a longitudinal axis of the elongated slots). To remove the light mount the second fasteners can be turned 90° and the firearm accessory can be removed with the second fasteners passing through the elongated slot.

Figure 4:
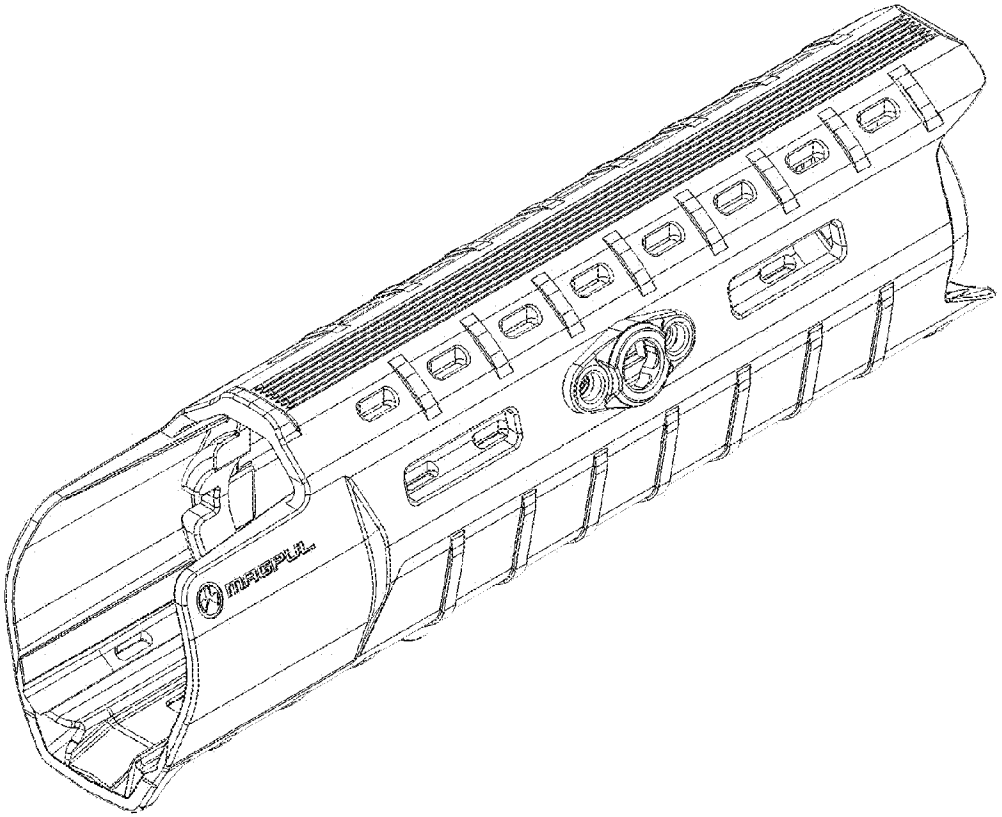
FIG. 4 is a perspective view of another firearm accessory removably coupled to a handguard.

FIG. 4 shows a quick detach (QD) female portion mounted to a handguard via an embodiment of the firearm accessory mounting interface of this disclosure. In this case the QD female portion is aligned with a middle of three elongated slots on a left side of the handguard, but is not shown with the first elongated fasteners or the second fasteners that would be used to mount the QD female portion to the handguard.

Figure 5:
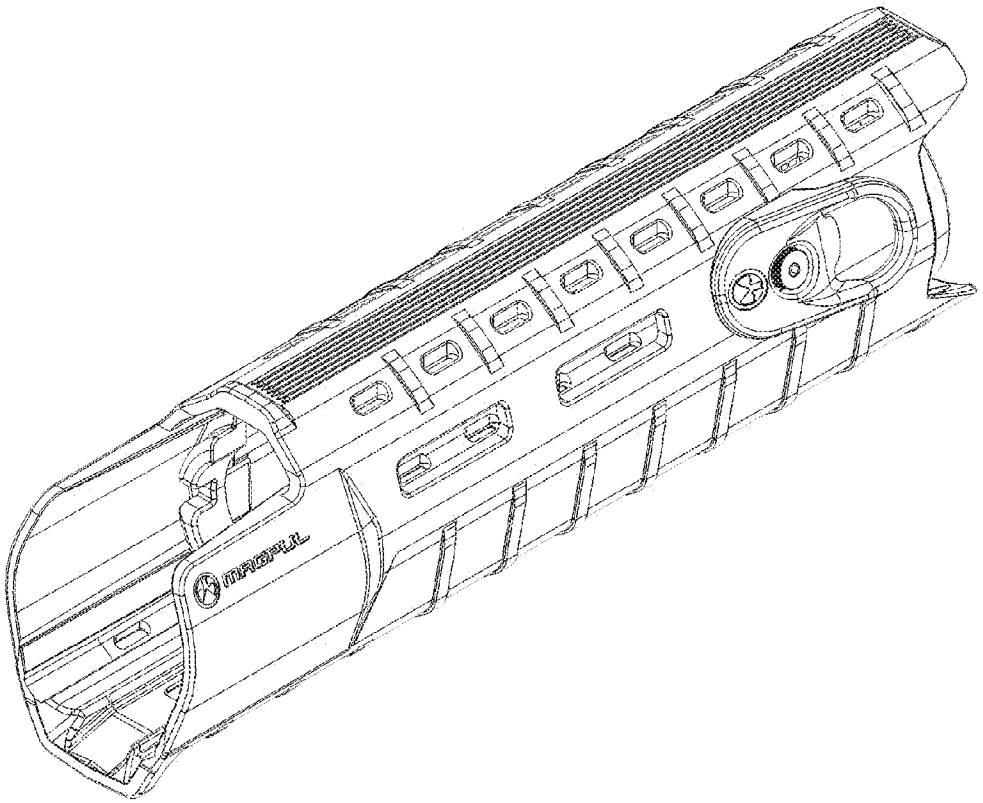
FIG. 5 is a perspective view of another firearm accessory removably coupled to a handguard.

FIG. 5 shows a sling mount coupled to a handguard via an embodiment of the firearm accessory mounting interface of this disclosure. Here, the firearm accessory mounting interface includes one of three elongated slots on a left side of a handguard as well as a first elongated fastener that passes through a through-hole of the sling mount and threads into a threaded portion of a second fastener arranged to pass through the elongated slot and pivot so as to lock against an inner surface of the handguard.

Figure 6:
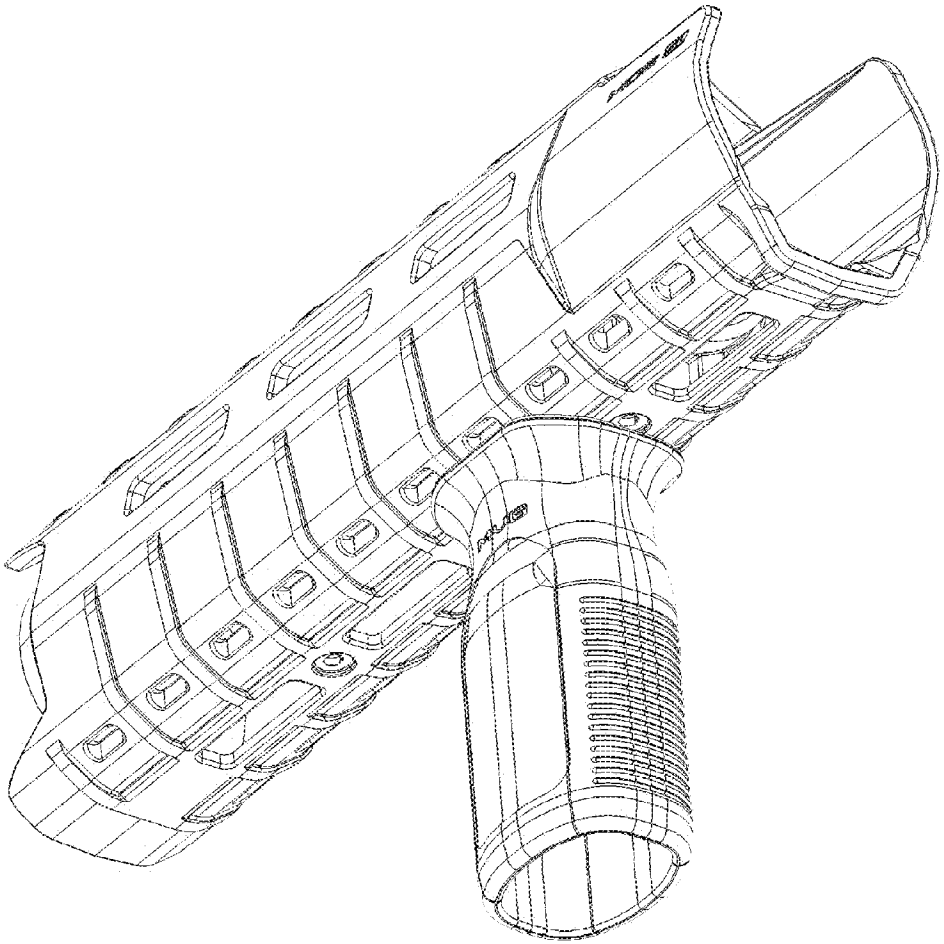
FIG. 6 is a perspective view of another firearm accessory removably coupled to a handguard.
Figure 7:
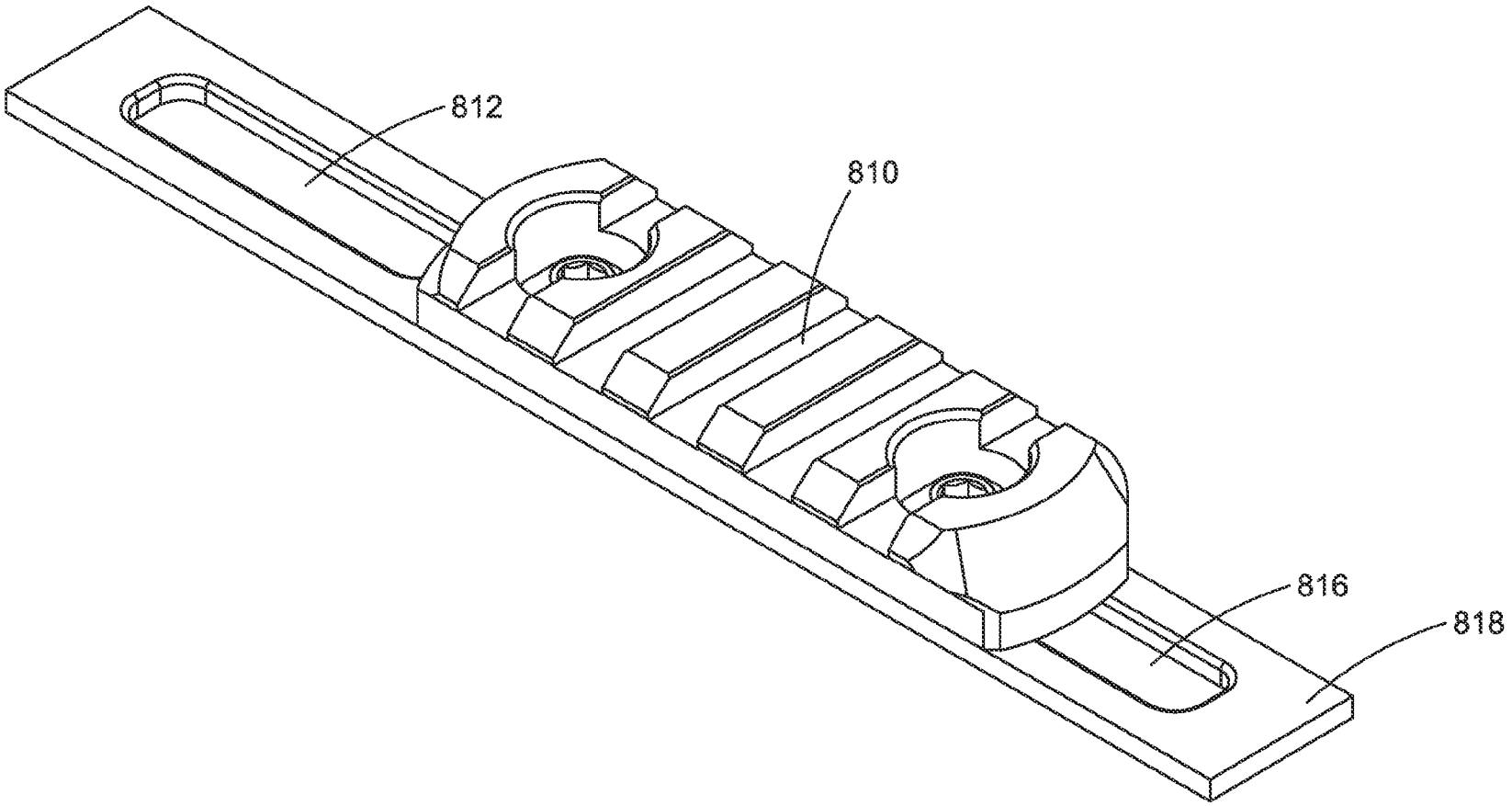
FIG. 7 is a perspective view of an embodiment of a firearm accessory mounting interface including a firearm accessory mounted to a portion of a firearm via one or more pairs of first and second mated fasteners.

FIG. 6 shows a vertical grip coupled to a handguard via an embodiment of the firearm accessory mounting interface of this disclosure. Here, the firearm accessory mounting interface includes one of four elongated slots on a bottom of a handguard as well as one or two pairs of first elongated fasteners and second fasteners that are used to couple the vertical grip to the handguard.

Figure 8:
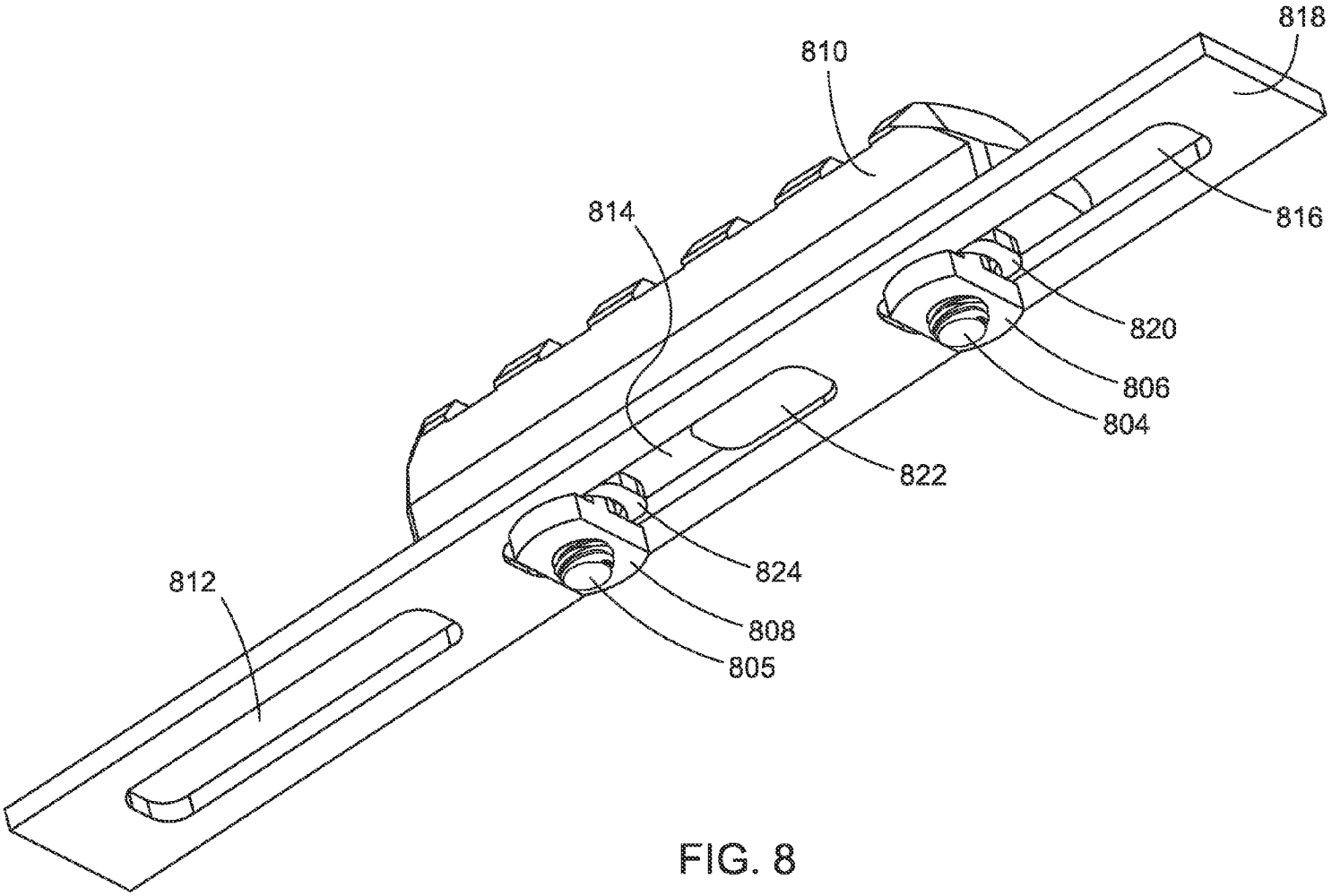
FIG. 8 is a bottom perspective view of an embodiment of a firearm accessory mounting interface including a firearm accessory mounted to a portion of a firearm via one or more pairs of first and second mated fasteners.
Figure 9:
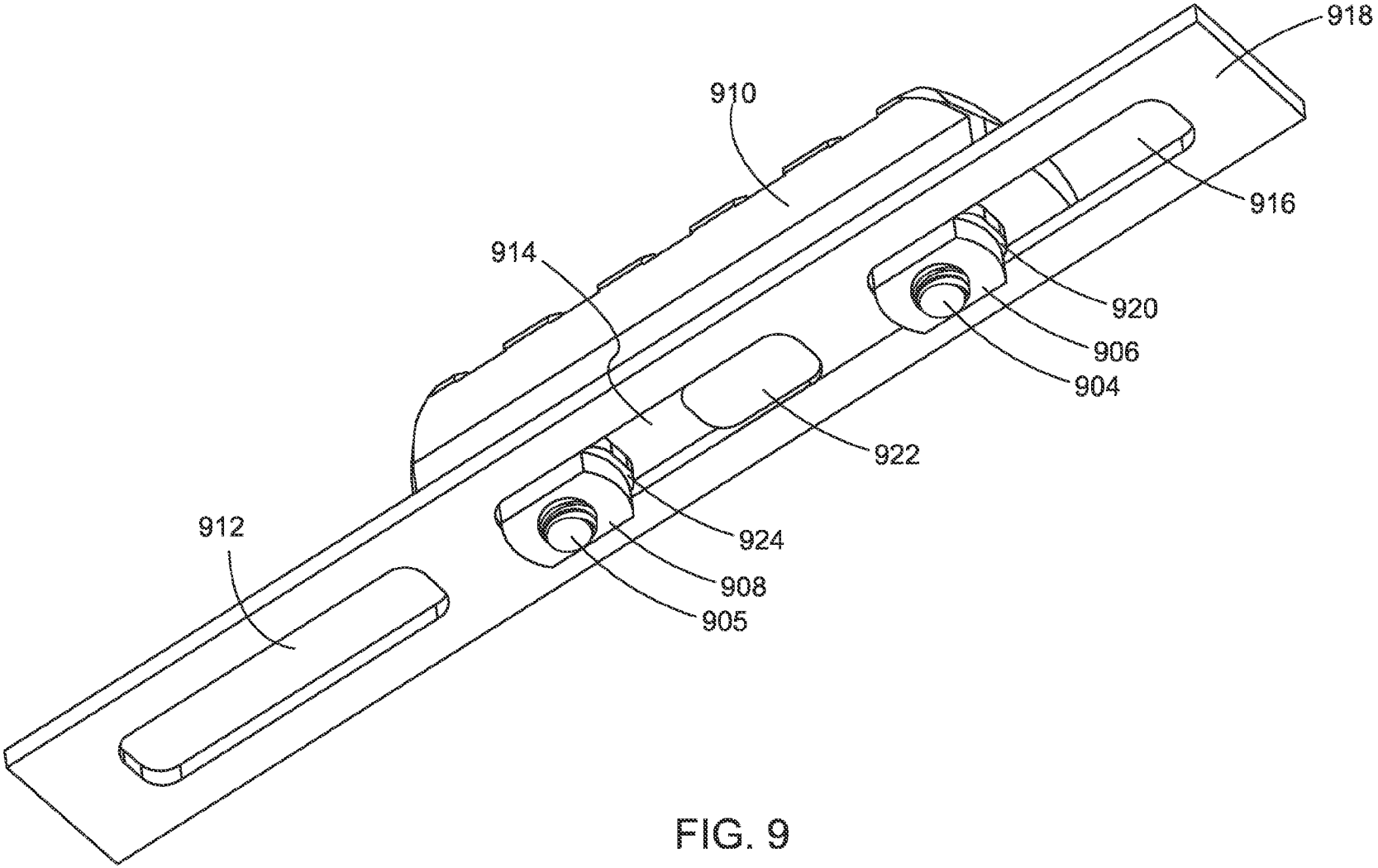
FIG. 9 is a bottom perspective view of the firearm accessory mounting interface of FIG. 8, but where the second fasteners are in an open position.
Figure 10:
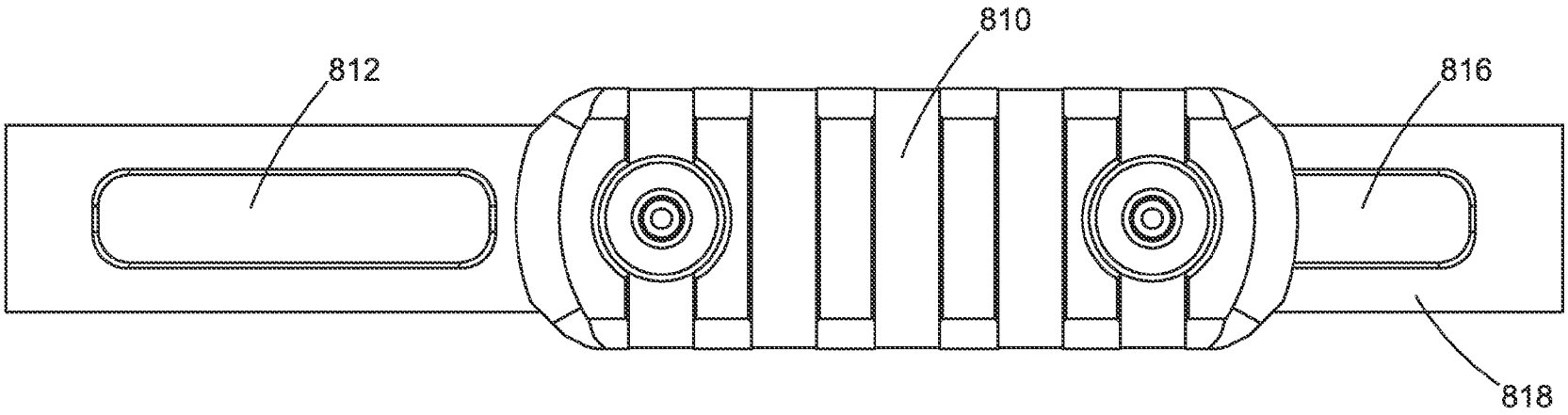
FIG. 10 is a top view of an embodiment of a firearm accessory mounting interface including a firearm accessory mounted to a portion of a firearm via one or more pairs of first and second mated fasteners.
Figure 11:
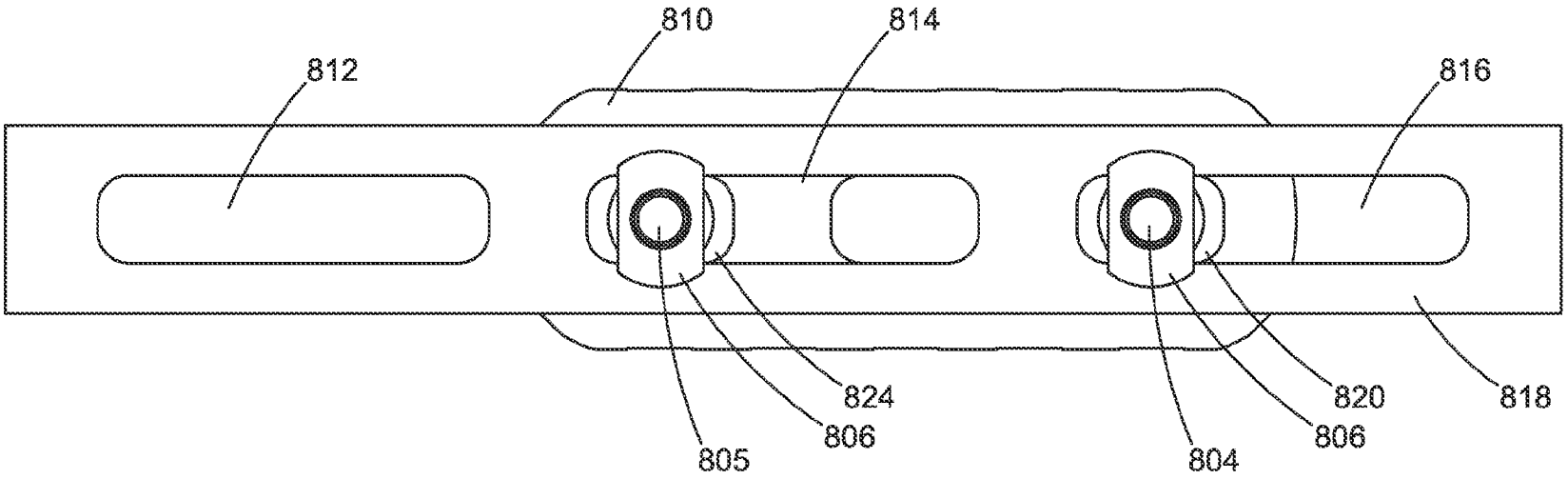
FIG. 11 is a bottom view of an embodiment of a firearm accessory mounting interface including a firearm accessory mounted to a portion of a firearm via one or more pairs of first and second mated fasteners.
Figure 12:
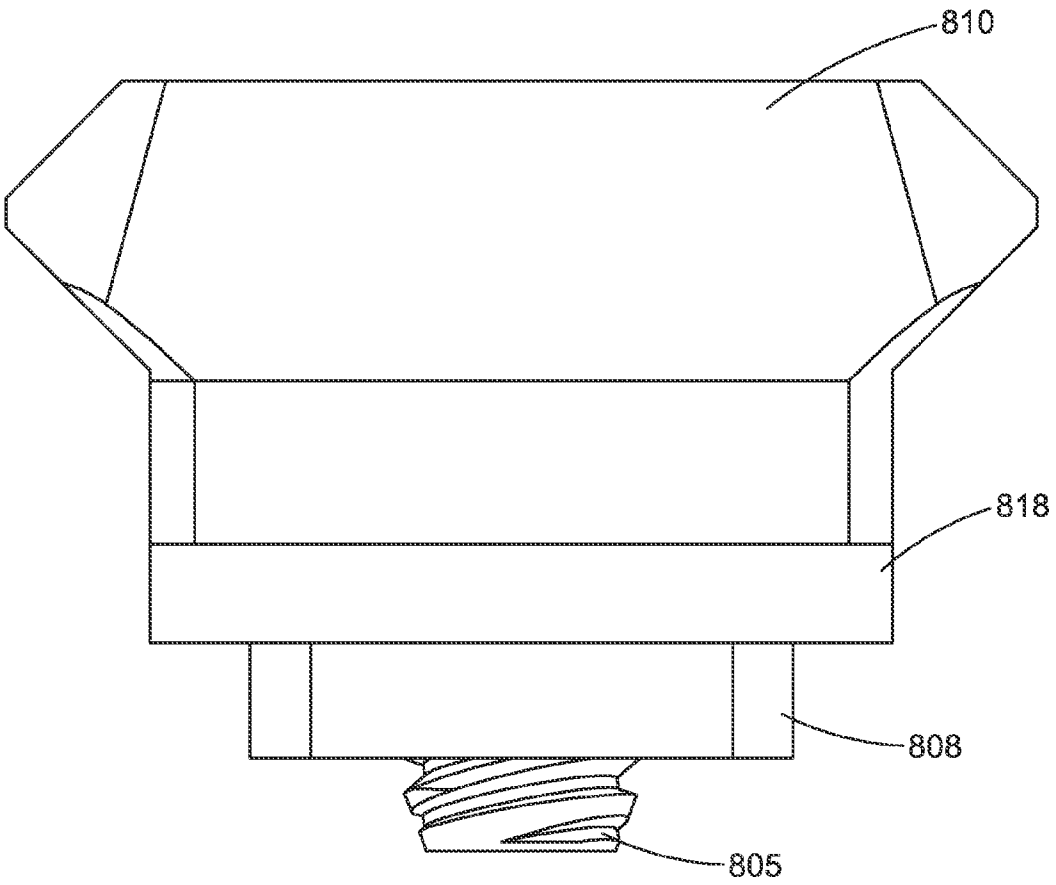
FIG. 12 is a front view of an embodiment of a firearm accessory mounting interface including a firearm accessory mounted to a portion of a firearm via one or more pairs of first and second mated fasteners.
Figure 13:
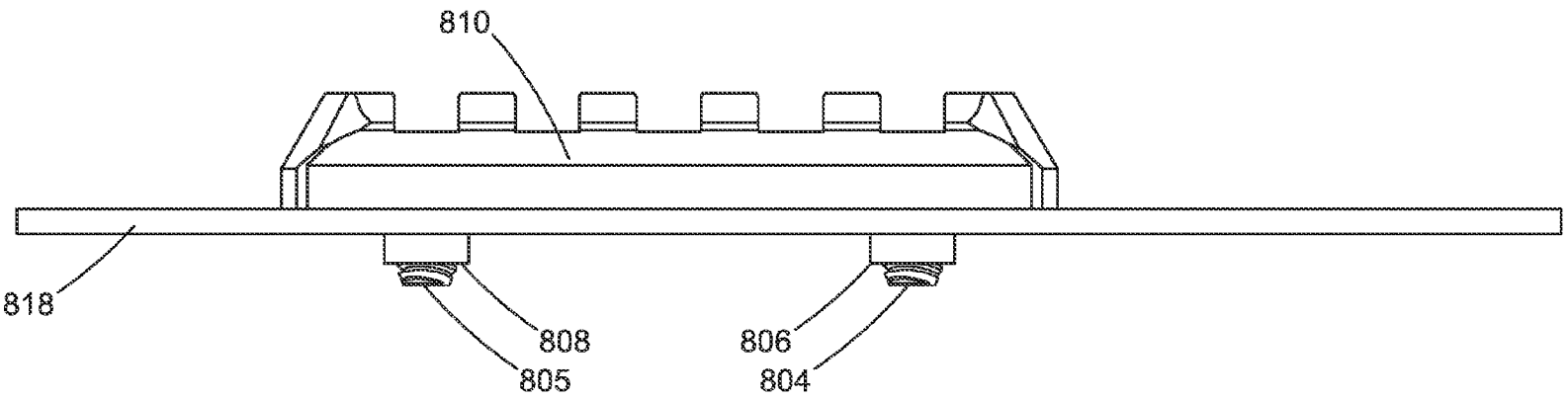
FIG. 13 is a side view of an embodiment of a firearm accessory mounting interface including a firearm accessory mounted to a portion of a firearm via one or more pairs of first and second mated fasteners.

FIGS. 7-13 show an embodiment of the firearm accessory mounting interface including a first elongated fastener, a second fastener, and three elongated slots in a portion of the firearm for mounting a firearm accessory to the firearm. To affix the firearm accessory 810 to the portion of the firearm 818, one or more first elongated fasteners 804, 805 can each be inserted through a respective through-hole of the firearm accessory 810 (a modular Picatinny rail) and threaded through at least a portion of a respective second fastener 806, 808. Each of the one or more second fasteners 806, 808 can start in an "open" position as illustrated in FIG. 9, such that the firearm accessory 810 can be pressed against the portion of the firearm 818 and the second fasteners 806, 808 can clear one or more elongated slots 812, 814, 816. Here, the second fasteners 806, 808 clear the second and third elongated slots 814, 816. The second fasteners 806, 808 are then tightened resulting in a 45°-135° rotation of each second fastener 806, 808 (e.g., via a 90° turn into a "locked" or "closed" position) and a pinching or squeezing of the portion of the firearm 818 between the second fasteners 806, 808 and the firearm accessory 810 thereby locking the firearm accessory 810 to the firearm (as seen in FIG. 8).

The illustrated embodiment is designed so that the firearm accessory 810 is unable to slide along the elongated slots 812, 814, 816 before the second fasteners 806, 808 are tightened. This is achieved via use of optional slot protrusions 820, 822, 824 spaced such that the firearm accessory 810 is unable to move side to side once the slot protrusions 820, 822, 824 are inserted partially into the elongated slots 812, 814, 816. For instance, a distance between opposing ends of the second and third slot protrusions 822, 824 is equal to or slightly less than a length of the second elongated slot 814. Similarly, a distance between adjacent ends of the first and second slot protrusions 820, 822 is equal to or slightly greater than a distance between the second and third elongated slots 814, 816. Said another way, the slot protrusions 820, 822, 824 can be positioned so that one edge of two or more of the slot protrusions 820, 822, 824 coincides with an end of one or more elongated slots 812, 814, 816. These slot protrusions 820, 822, 824 can be more readily seen in FIG. 22.

Without slot protrusions 820, 822, 824, the one or more second fasteners 806, 808 the firearm accessory 818 can be slid along a long dimension of the elongated slots 812, 814, 816 until a desired position is achieved, and then the second fasteners 806, 808 can be tightened into a locked position.

One of skill in the art will recognize the portion of the firearm 818 as a cutaway of a firearm (e.g., a handguard or stock) and thus does not show the entire firearm nor give any indication as to what firearm or what portion of the firearm the portion of the firearm 818 belongs to. This is intended so that the herein disclosed firearm accessory mounting interface can be envisioned in a variety of different places throughout a firearm.

Figure 14A:
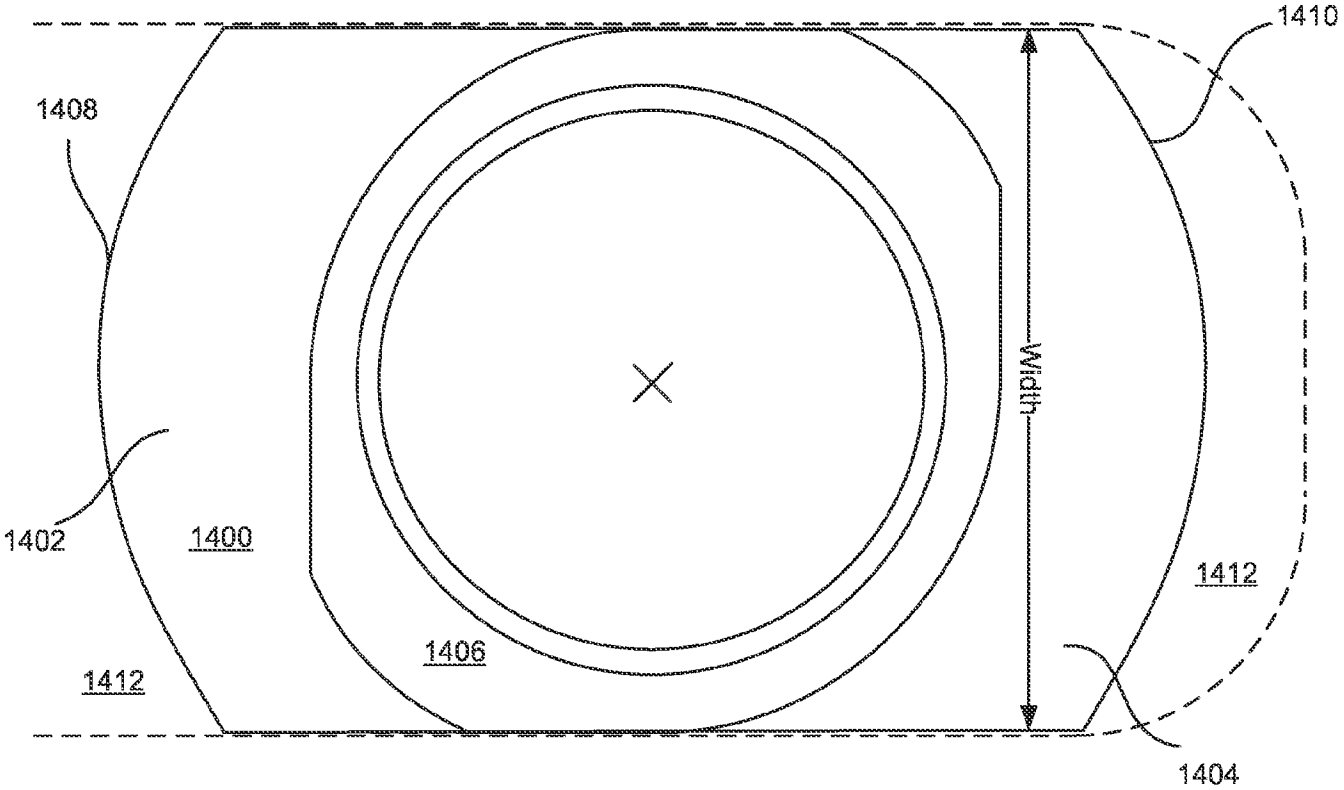
FIGS. 14A and B show two top views of an embodiment of a second fastener relative to an elongated slot for an open and closed position of the second fastener.
Figure 14B:
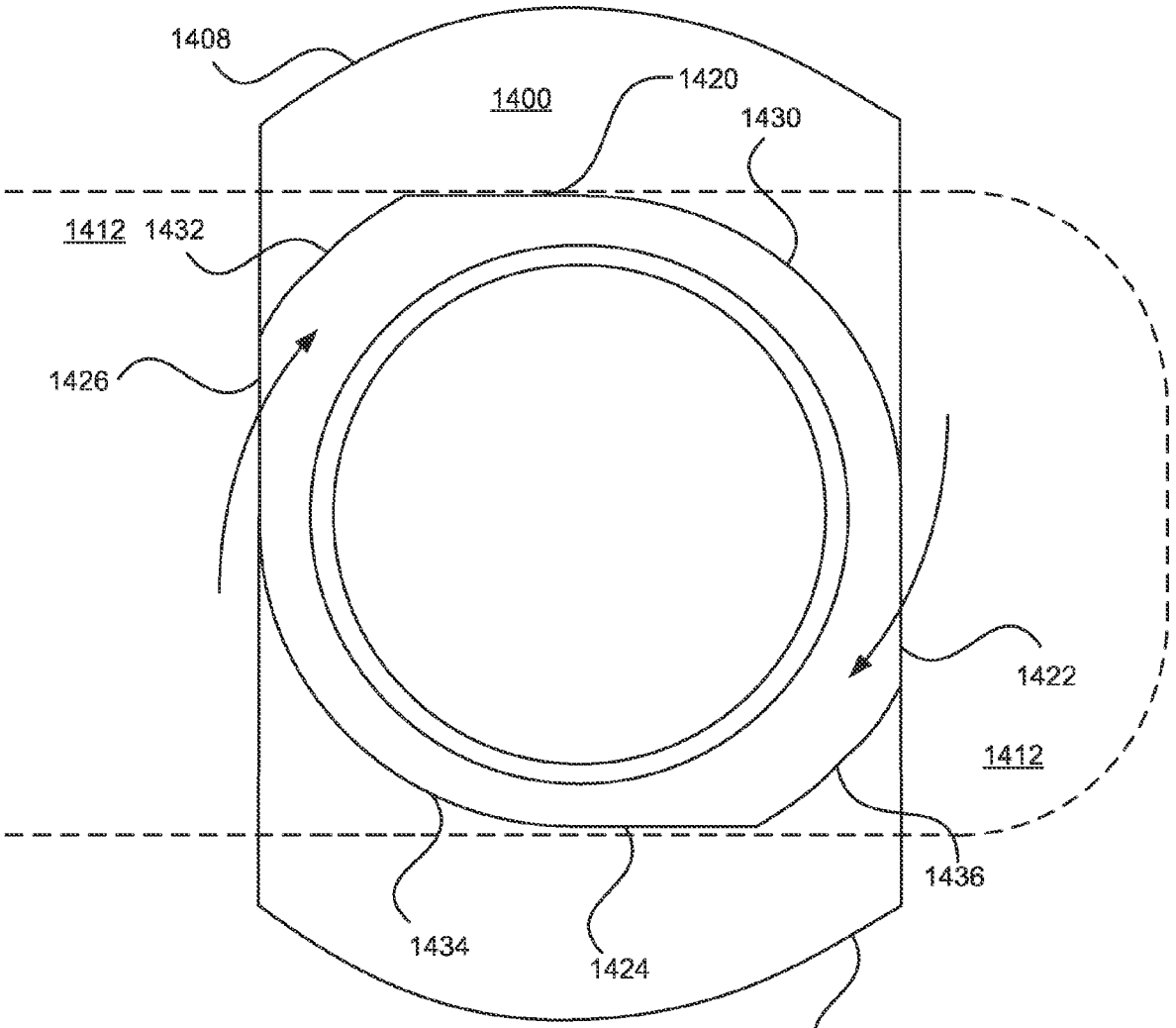
Figure 15:
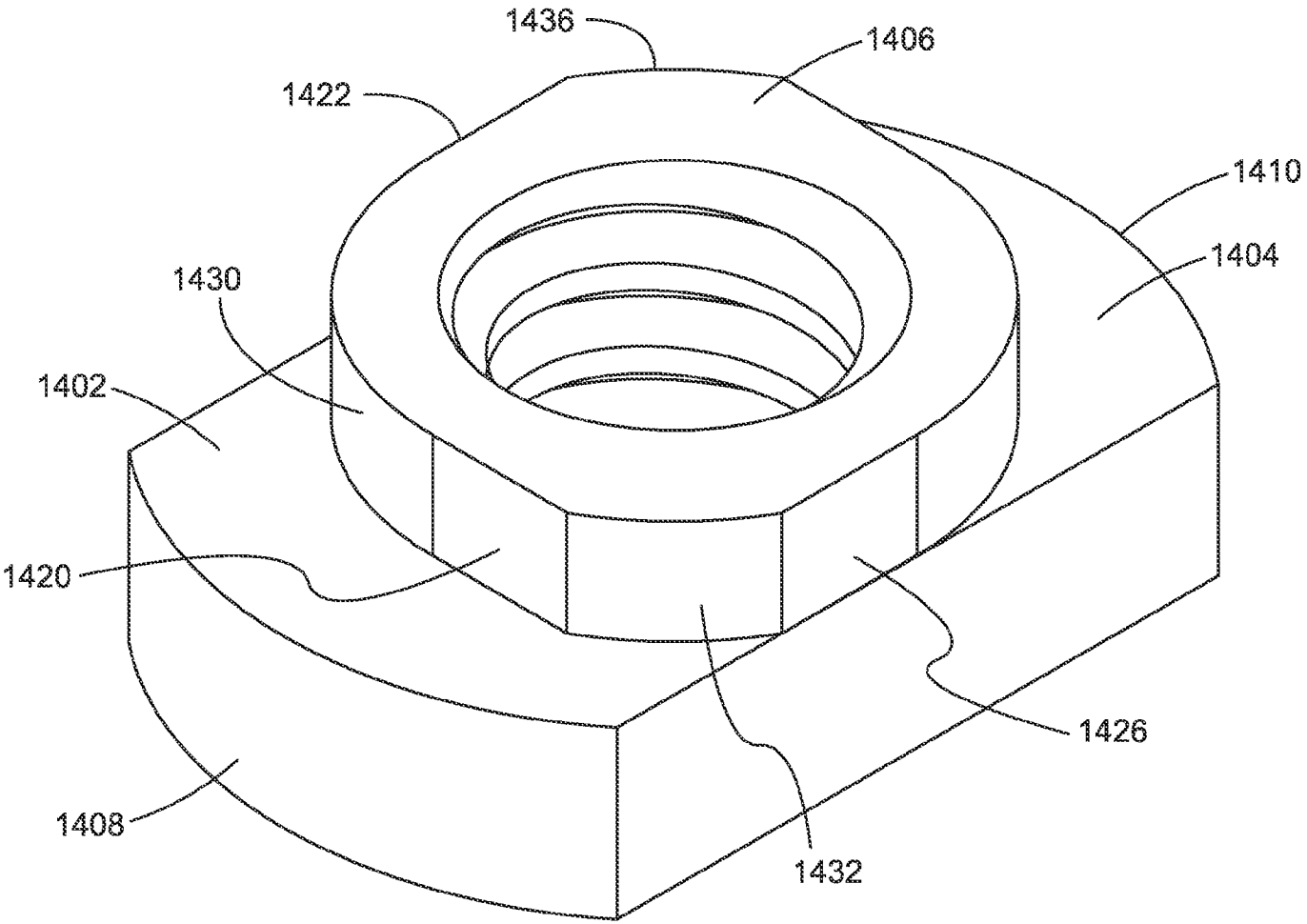
FIG. 15 is a perspective view of a second fastener according to an embodiment of this disclosure.
Figure 16:
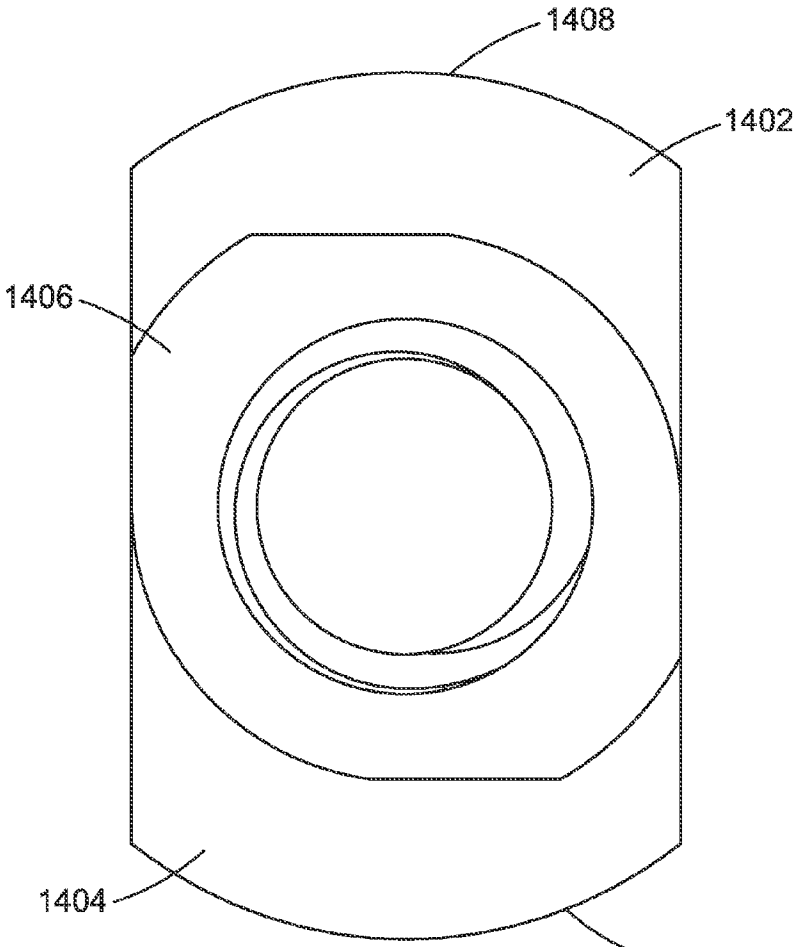
FIG. 16 is a top plan view of the second fastener according to an embodiment of this disclosure.
Figure 17:
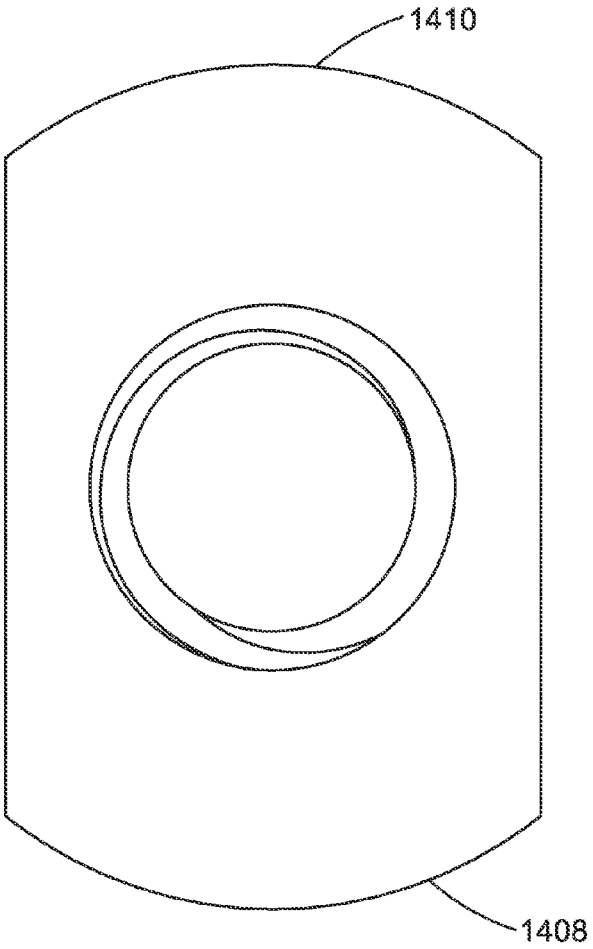
FIG. 17 is a bottom plan view of the second fastener according to an embodiment of this disclosure.
Figure 18:
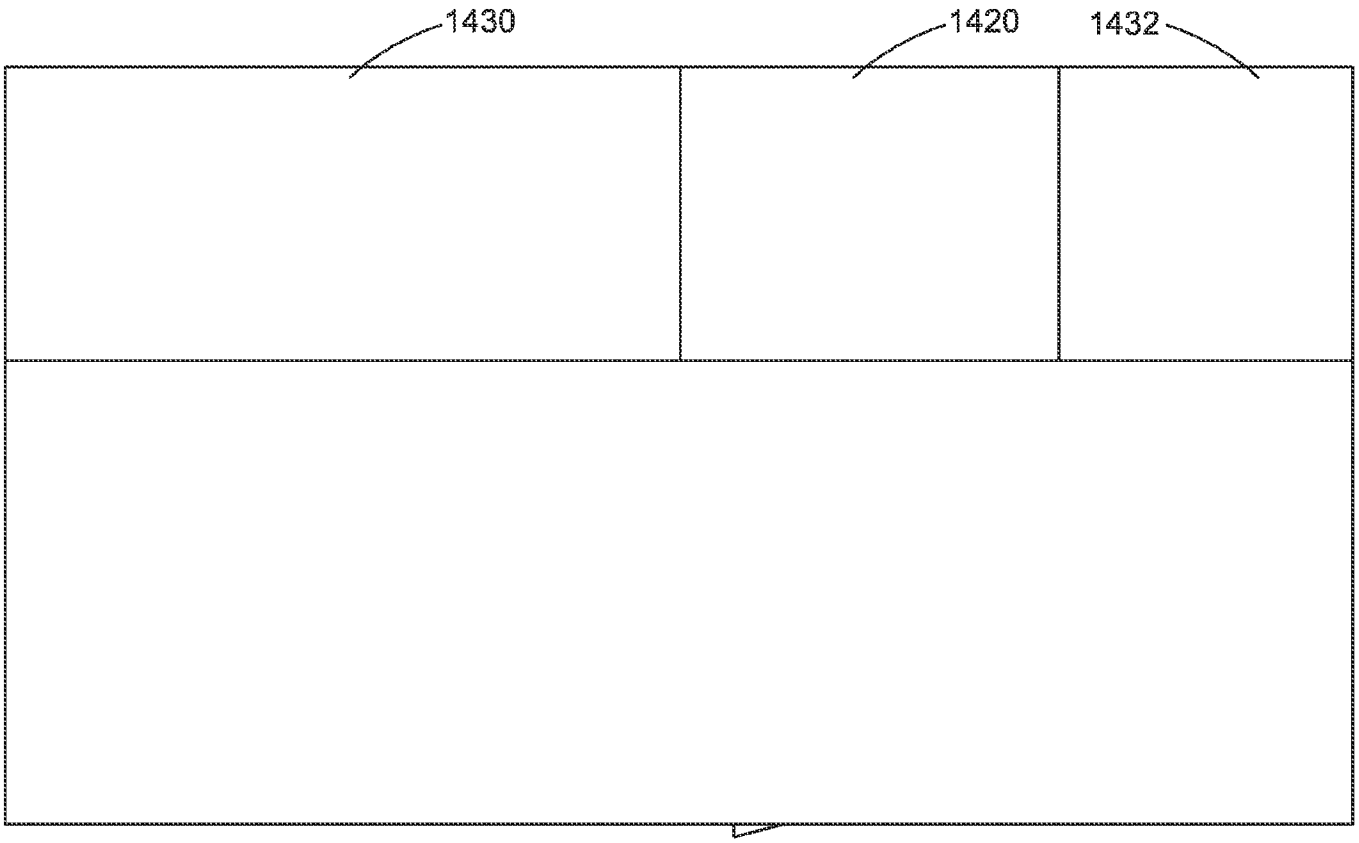
FIG. 18 is a front elevation view of the second fastener according to an embodiment of this disclosure.
Figure 19:
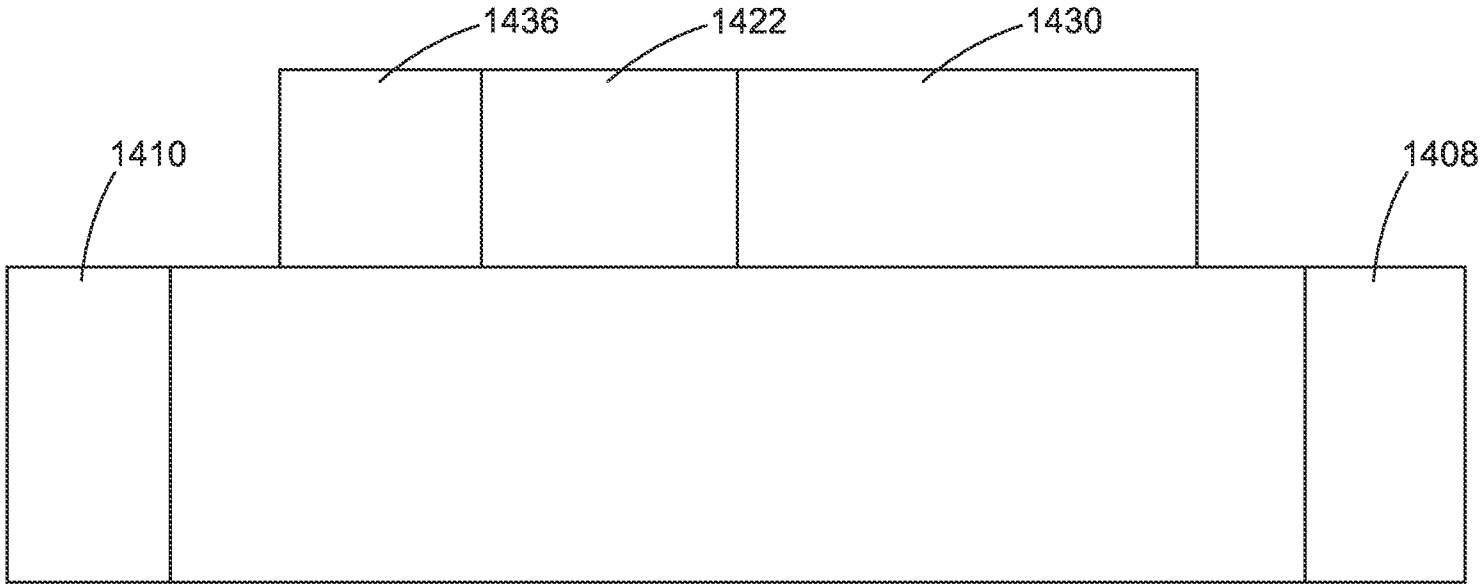
FIG. 19 is a side elevation view of the second fastener according to an embodiment of this disclosure.
Figure 20:
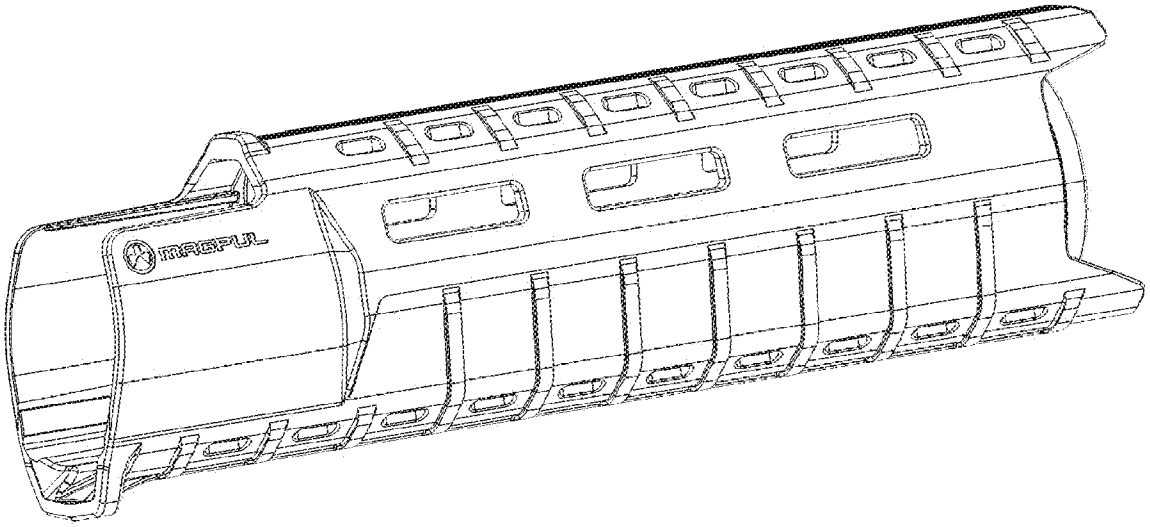
FIG. 20 is a perspective view of an embodiment of a handguard having three rows of elongated slots, one row on each side, and one row on the bottom.
Figure 21:
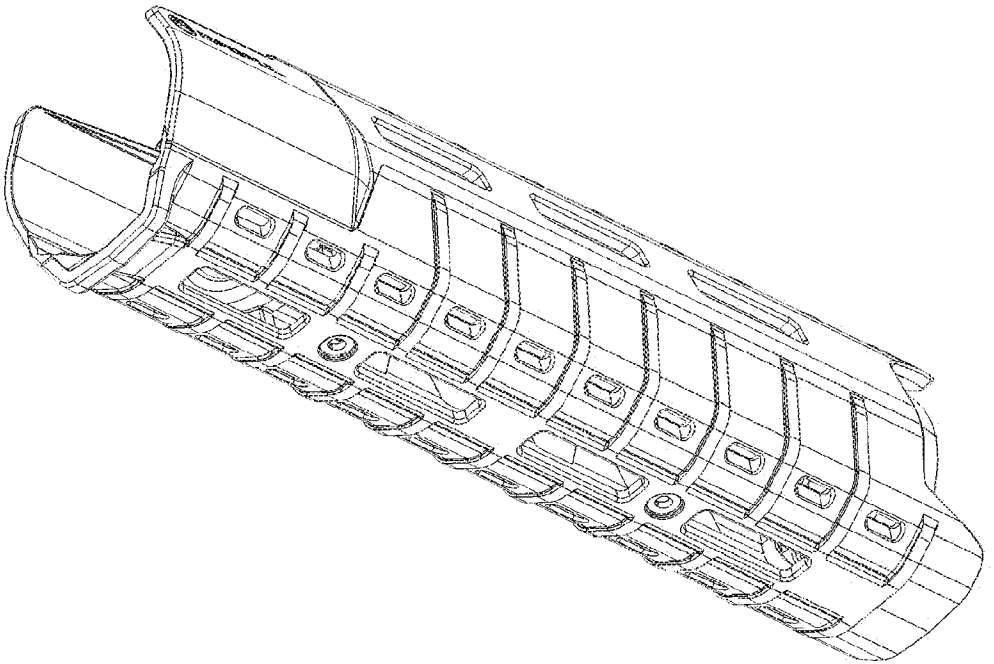
FIG. 21 is a perspective view of an the handguard of FIG. 20 having three rows of elongated slots, one row on each side, and one row on the bottom.

FIGS. 14A and B show an embodiment of a second fastener (e.g., a nut) and an elongated slot where the second fastener is in an open position (top figure) and a closed or locked position (bottom figure). In an embodiment, the second fastener can be referred to as a T-nut due to its profile. FIGS. 15-19 illustrate further views of the second fastener seen in FIGS. 14A and B. The second fastener 1400 can include a first flange 1402, a second flange 1404 (that together can be referred to as an elongated lug), and an upper locking portion 1406. In an embodiment, the second fastener 1400 can be threaded so as to form a female half of a threaded screw-nut interface. The threading can define a central axis of the second fastener (identified with an "x" in a center of the second fastener 1400). The first and second flanges 1402, 1404 can extend away from the central axis in two directions where each flange 1402, 1404 can be symmetric to the other flange 1402, 1404. However, and as seen in subsequent embodiments (e.g., FIGS. 42-51), the flanges 1402, 1404 need not be symmetric. In some cases, the second fastener 1400 may only include a single flange (e.g., FIGS. 42-46). Each of the first and second flanges 1402, 1404 can have curved ends 1408, 1410, and in the illustrated embodiment, the curved ends 1408, 1410 are centered on the axis of the second fastener 1400. However, in other embodiments, the ends can include straight and curved portions (e.g., 24-51) or angled and curved portions (e.g., FIGS. 29-32).

A width of the second fastener 1400 is equal to or slightly smaller than a width of the elongated slot 1412 through which the second fastener 1400 is designed to pass through when in an open position. A length of the second fastener 1400 is greater than the width of the elongated slot 1412, such that when the second fastener 1400 is turned into a locked or closed position, the second fastener 1400 cannot be retracted through the elongated slot 1412. Instead, tightening of a complementary first fastener that threads through the second fastener 1400 causes the second fastener 1400 and the complementary first fastener to approach each other and thereby press a portion of a firearm accessory therebetween and lock a firearm accessory onto a firearm.

Figure 28:
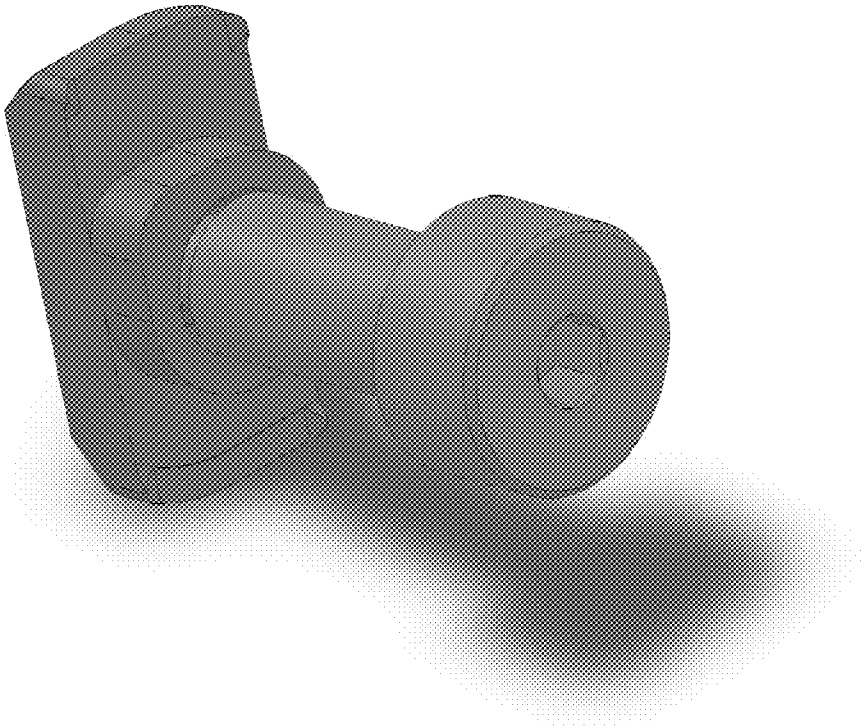
FIG. 28 is a perspective view of a first fastener partially threaded into the second fastener of FIG. 24.
Figure 29:
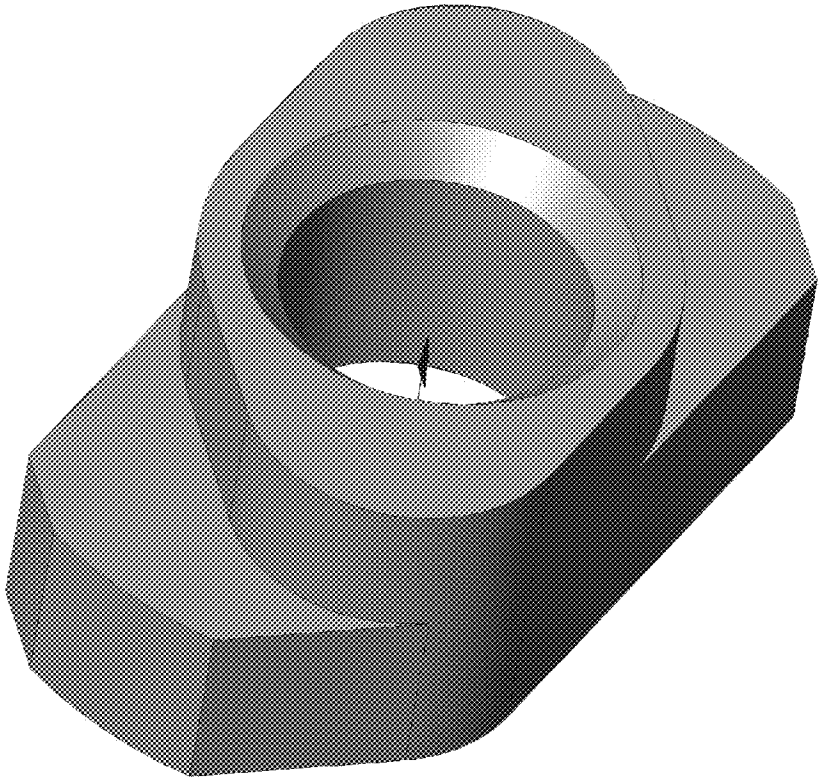
FIG. 29 is a perspective view of a second fastener according to an embodiment of this disclosure.
Figure 30:
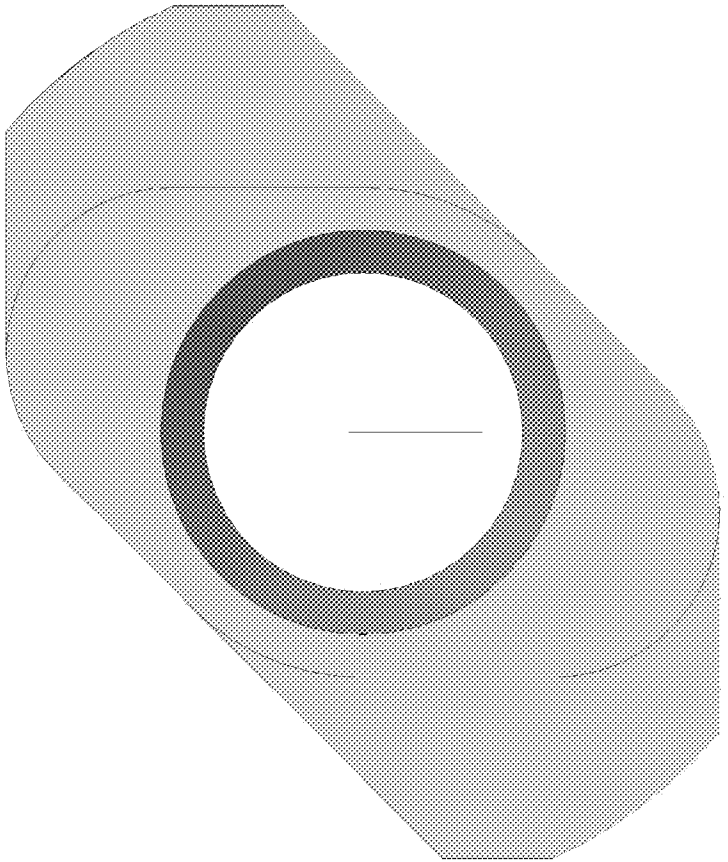
FIG. 30 is a top plan view of the second fastener of FIG. 29.
Figure 31:
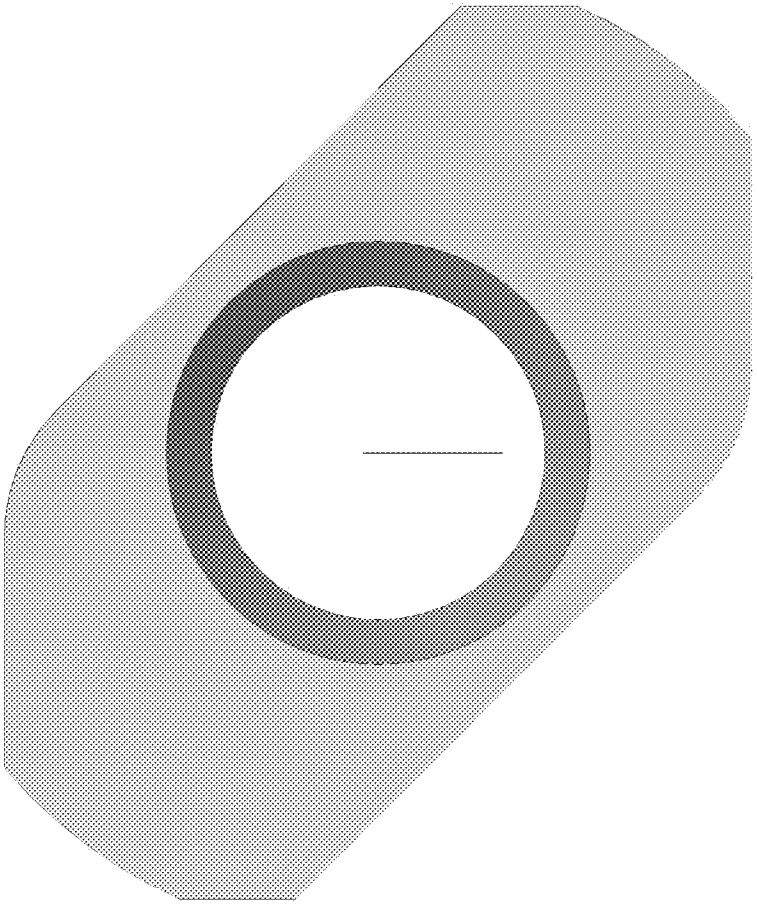
FIG. 31 is a bottom plan view of the second fastener of FIG. 29.
Figure 32:
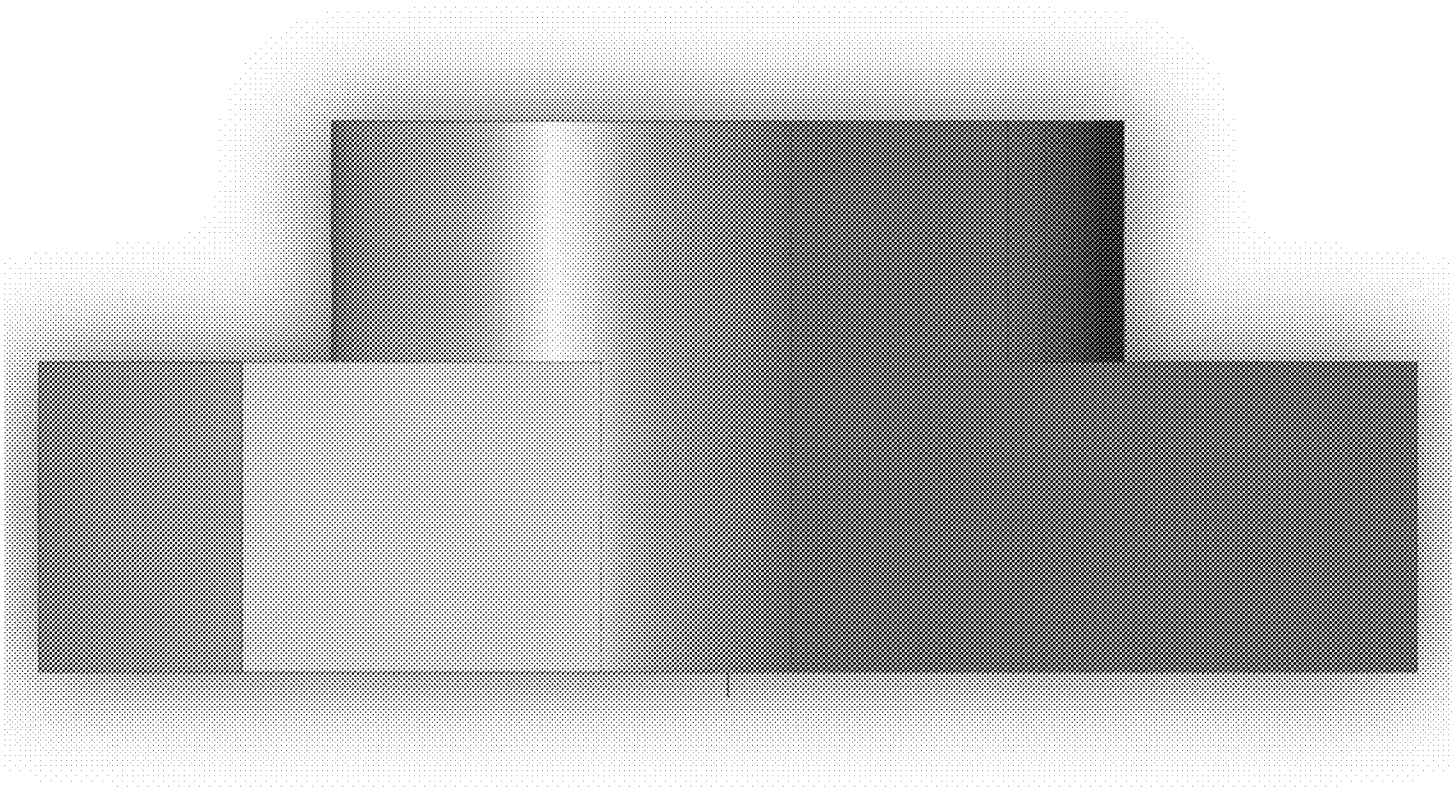
FIG. 32 is a side elevation view of the second fastener of FIG. 29.

The upper locking portion 1406 can surround a threaded female region that is designed to accept the threads of a complementary first fastener (see FIG. 28). When the complementary first fastener is rotated, the second fastener 1400 turns (clockwise in the illustration), but there is a preference for the second fastener 1400 to only turn between 45° and 135° since greater or lesser rotation would leave the second fastener 1400 in an unstable position where it could exit the elongated slot 1412. Thus, the upper locking portion 1406 can have up to four straight edges 1420, 1422, 1424, 1426 roughly opposing each other and each separated by one of four curved or arced edges 1430, 1432, 1434, 1436. Two of the curved or arced edges 1430, 1434 can have a first radius of curvature and two of the curved or arced edges 1432, 1436 can have a second radius. The straight edges 1420, 1422, 1424, 1426 can be arranged at 90' angles to each other, although in other configurations the straight edges 1420, 1422, 1424, 1426 could be arranged in a parallelogram with curved edges, such that angles between the straight edges 1420, 1422, 1424, 1426 are acute and oblique. In this way, the upper locking portion 1406 can pivot to a closed position (lower image) and then back to its open position (upper image), and is prevented from further rotation in either direction. In particular, the second fastener 1400 can only rotate where a curved edge 1430, 1434 is passing tangential to an edge of the elongated slot 1412. Once either of the straight edges 1420, 1422, 1424, 1426 becomes flush with an edge of the elongated slot 1412, no further rotation in the same direction is possible, thereby preventing the second fastener 1400 from rotating past an open or closed position, but enabling rotation between the open and closed positions. The curved edges 1430, 1434 can have a radius of curvature that is equal to or slightly less than half the width of the elongated slot 1412, and the radius of curvature can be centered in a center of the second fastener 1400. The radius of curvature of the curved edges 1432, 1436 can be greater than half the width of the elongated slot 1412, and greater than the radius of curvature of the arced or curved edges 1430, 1434 and this prevents the second fastener 1400 from turning past the open or closed positions shown in FIGS. 14A and 14B, respectively.

One of skill in the art will recognize that the orientation of the upper locking portion can be reversed such that rotation from an open to closed position occurs via counterclockwise pivoting of the second fastener 1400.

Figure 33:
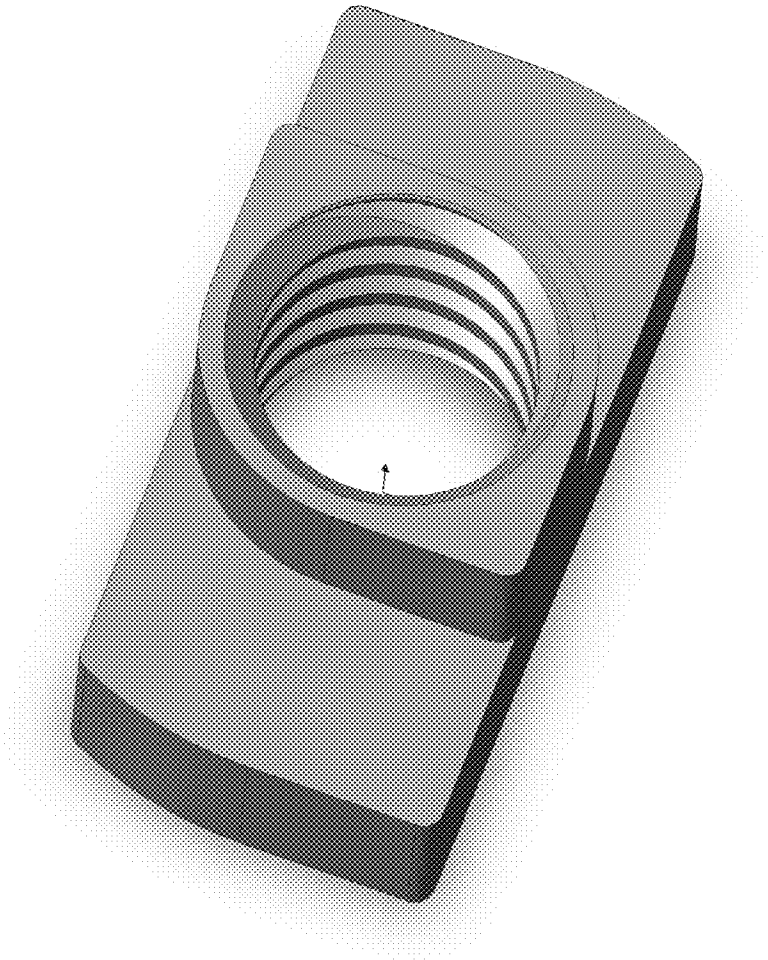
FIG. 33 is a perspective view of a second fastener according to an embodiment of this disclosure.
Figure 34:
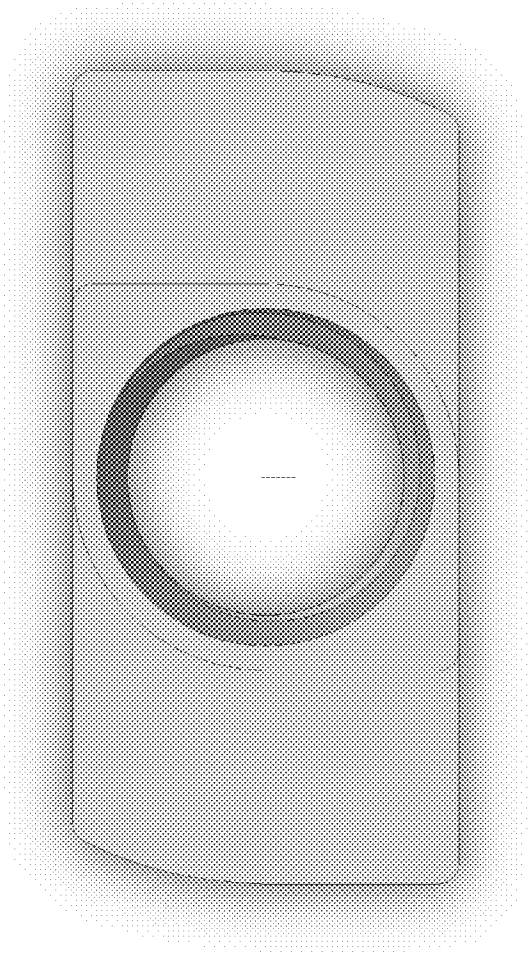
FIG. 34 is a top plan view of the second fastener of FIG. 33.
Figure 35:
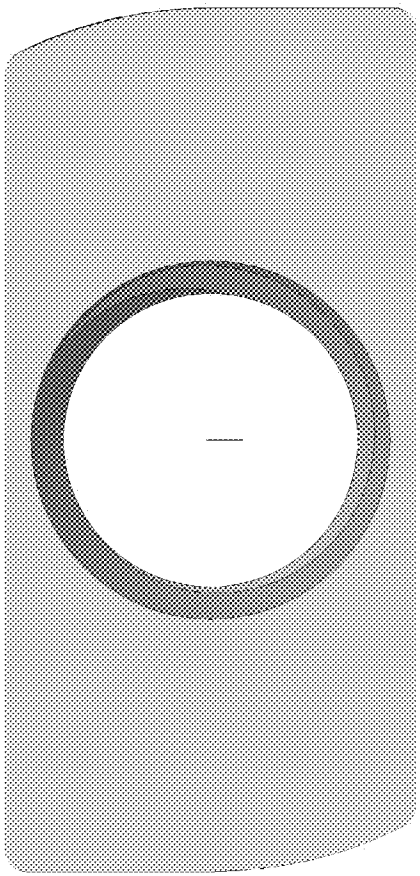
FIG. 35 is a bottom plan view of the second fastener of FIG. 33.
Figure 36:
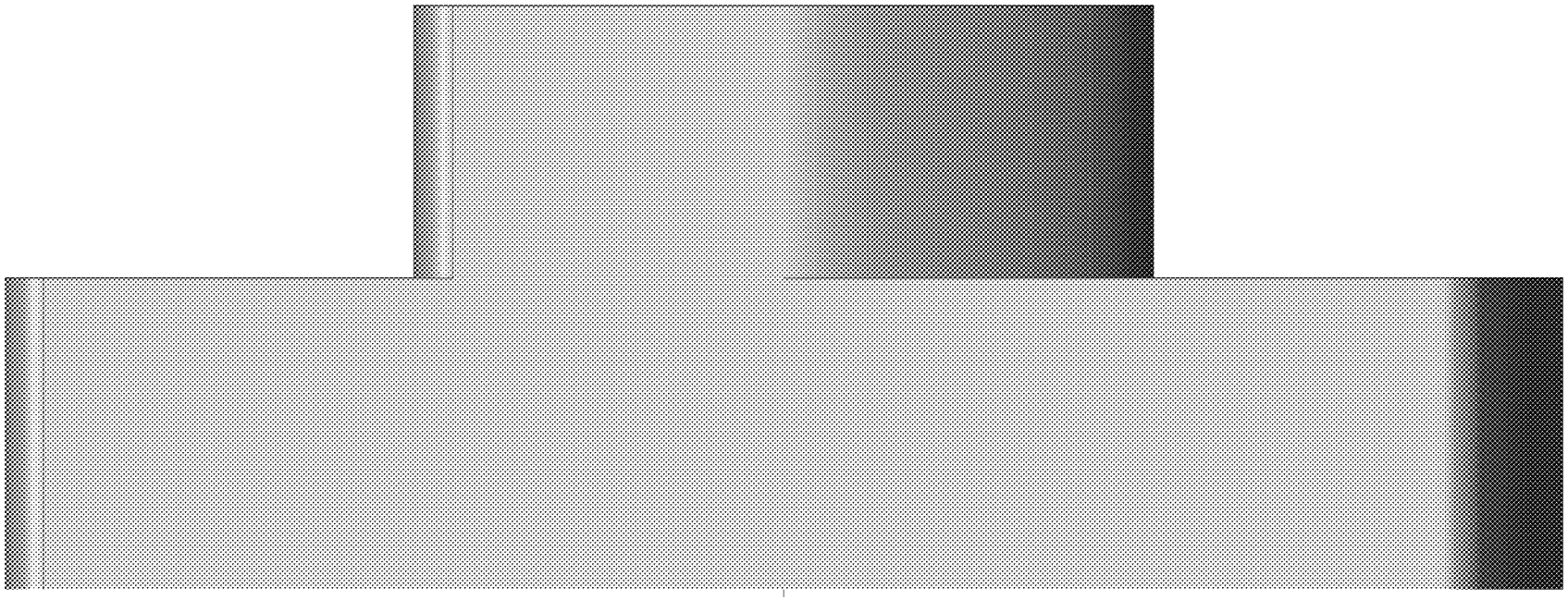
FIG. 36 is a side elevation view of the second fastener of FIG. 33.
Figure 37:
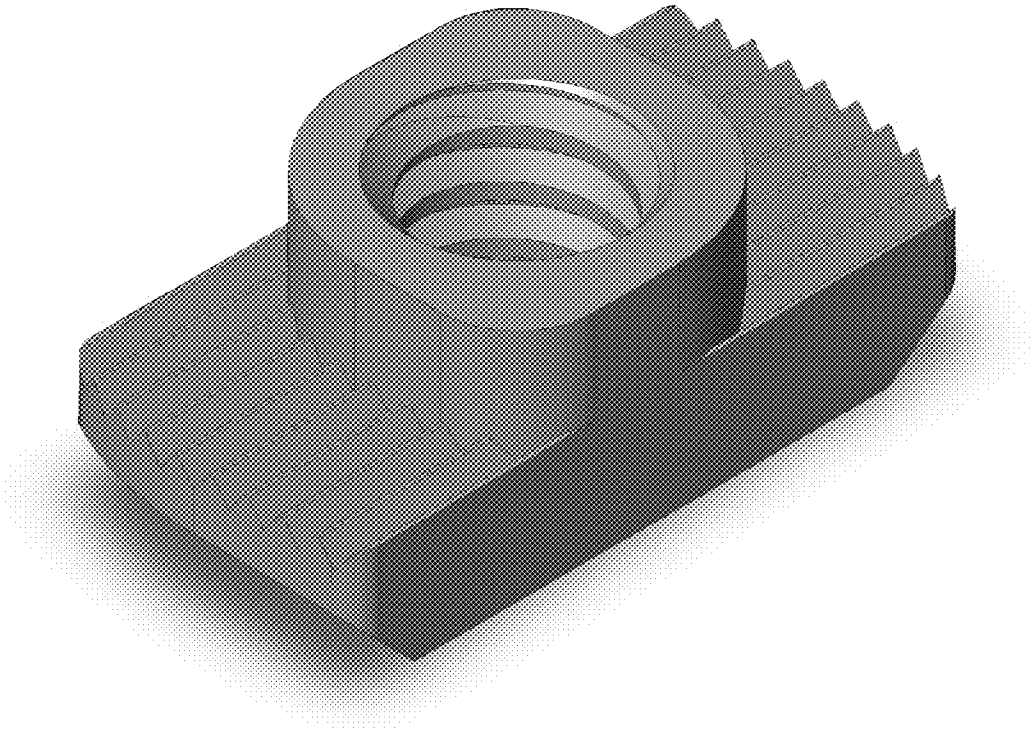
FIG. 37 is a perspective view of a second fastener according to an embodiment of this disclosure.
Figure 38:
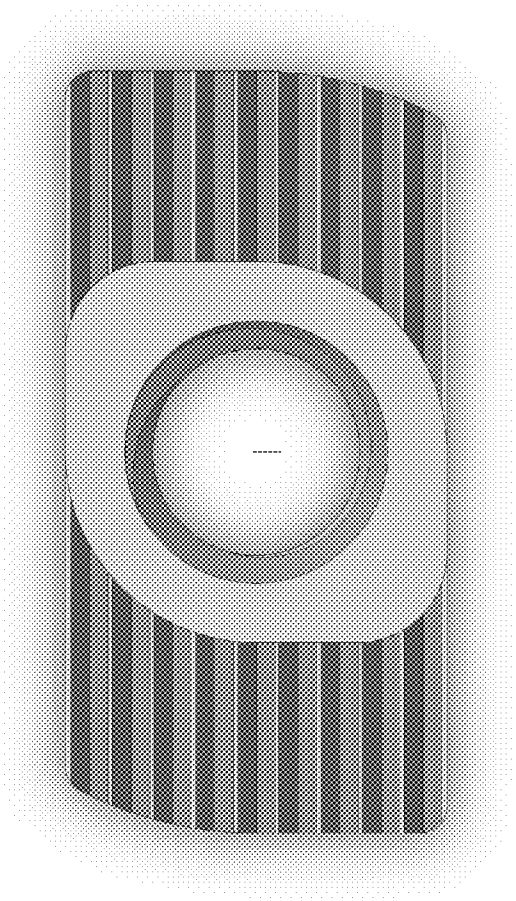
FIG. 38 is a top plan view of the second fastener of FIG. 37.
Figure 39:
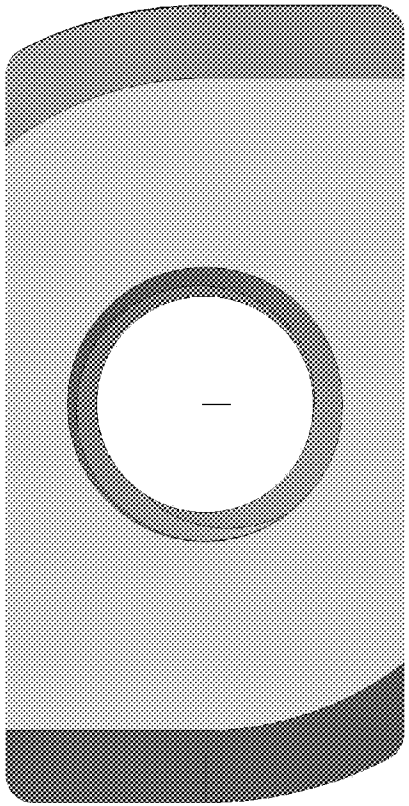
FIG. 39 is a bottom plan view of the second fastener of FIG. 37.
Figure 40:
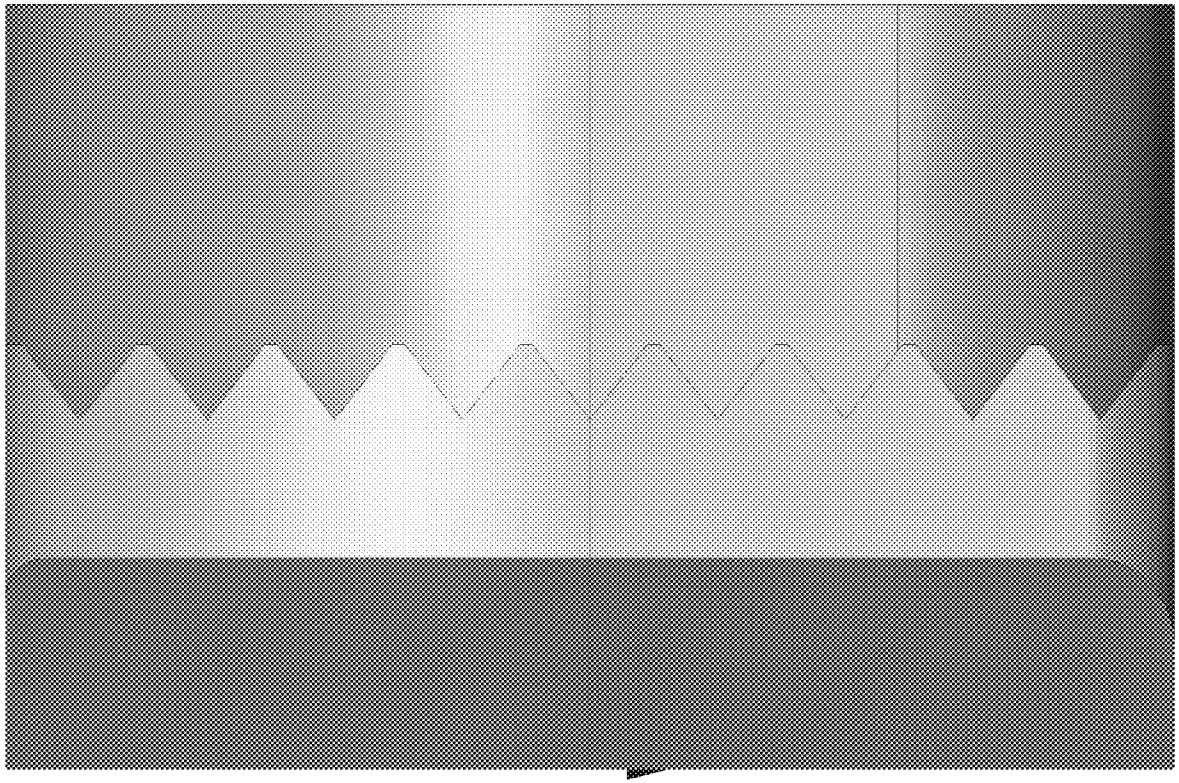
FIG. 40 is a front elevation view of the second fastener of FIG. 37.
Figure 41:
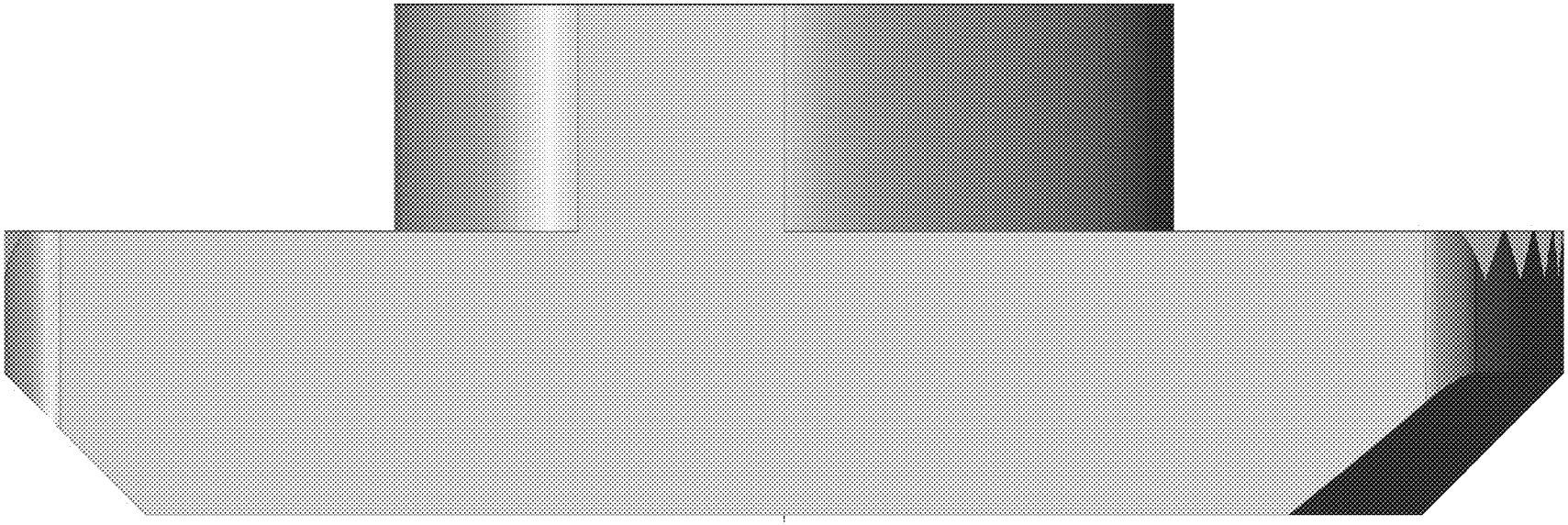
FIG. 41 is a side elevation view of the second fastener of FIG. 37.
Figure 42:
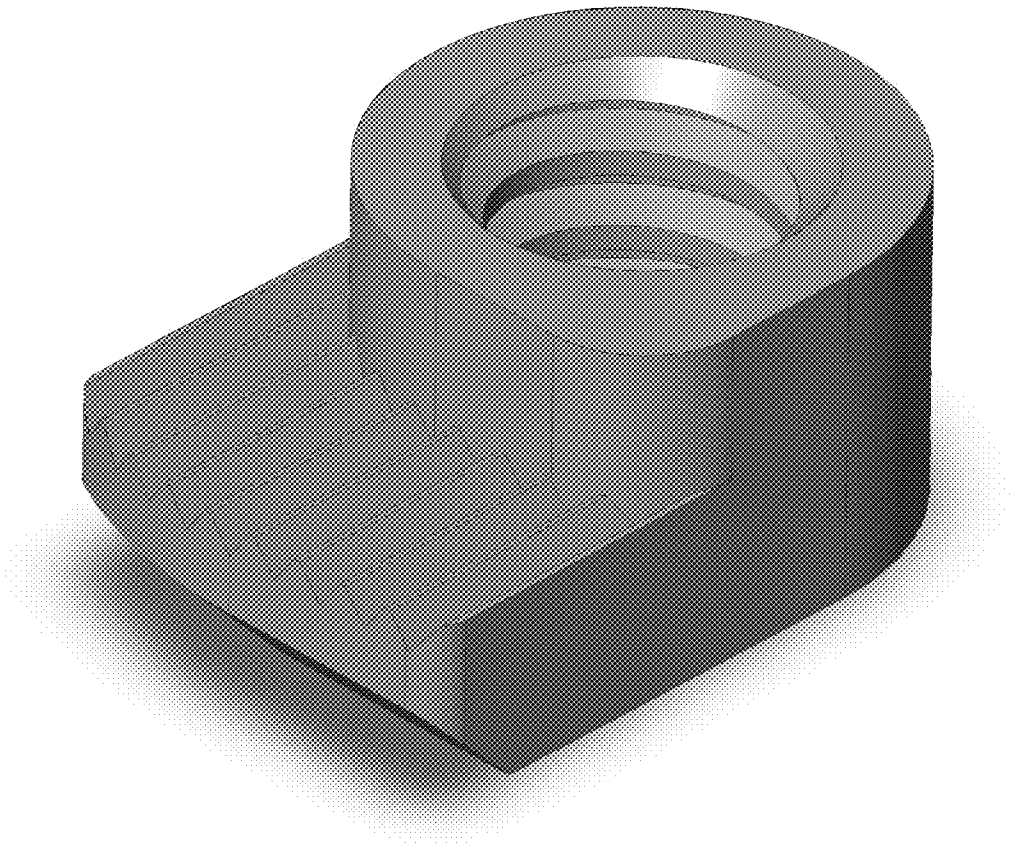
FIG. 42 is a perspective view of a second fastener according to an embodiment of this disclosure.
Figure 43:
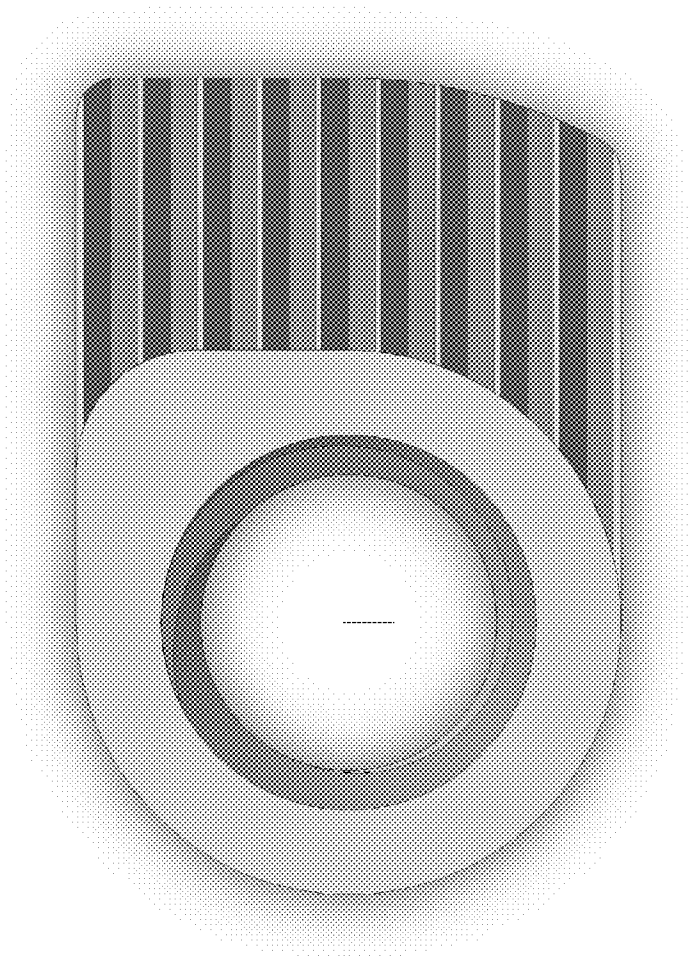
FIG. 43 is a top plan view of the second fastener of FIG. 42.
Figure 44:
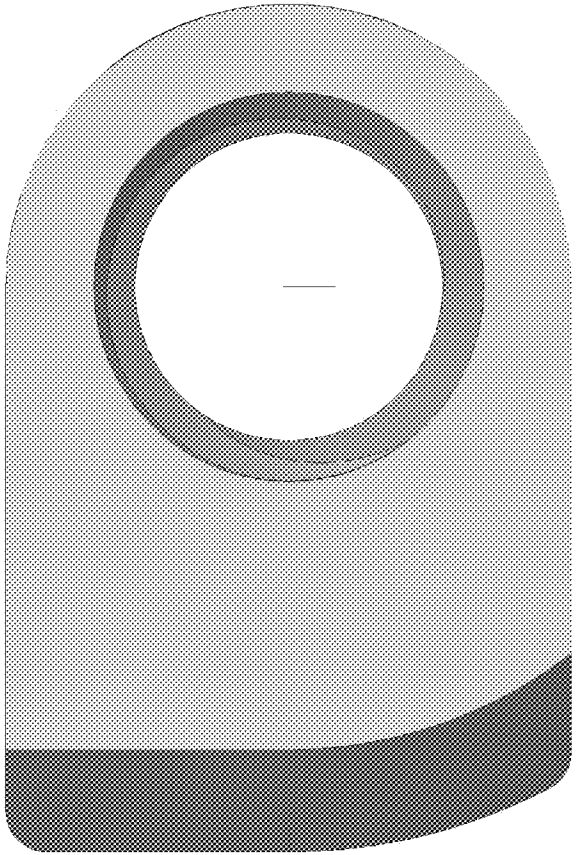
FIG. 44 is a bottom plan view of the second fastener of FIG. 42.
Figure 45:
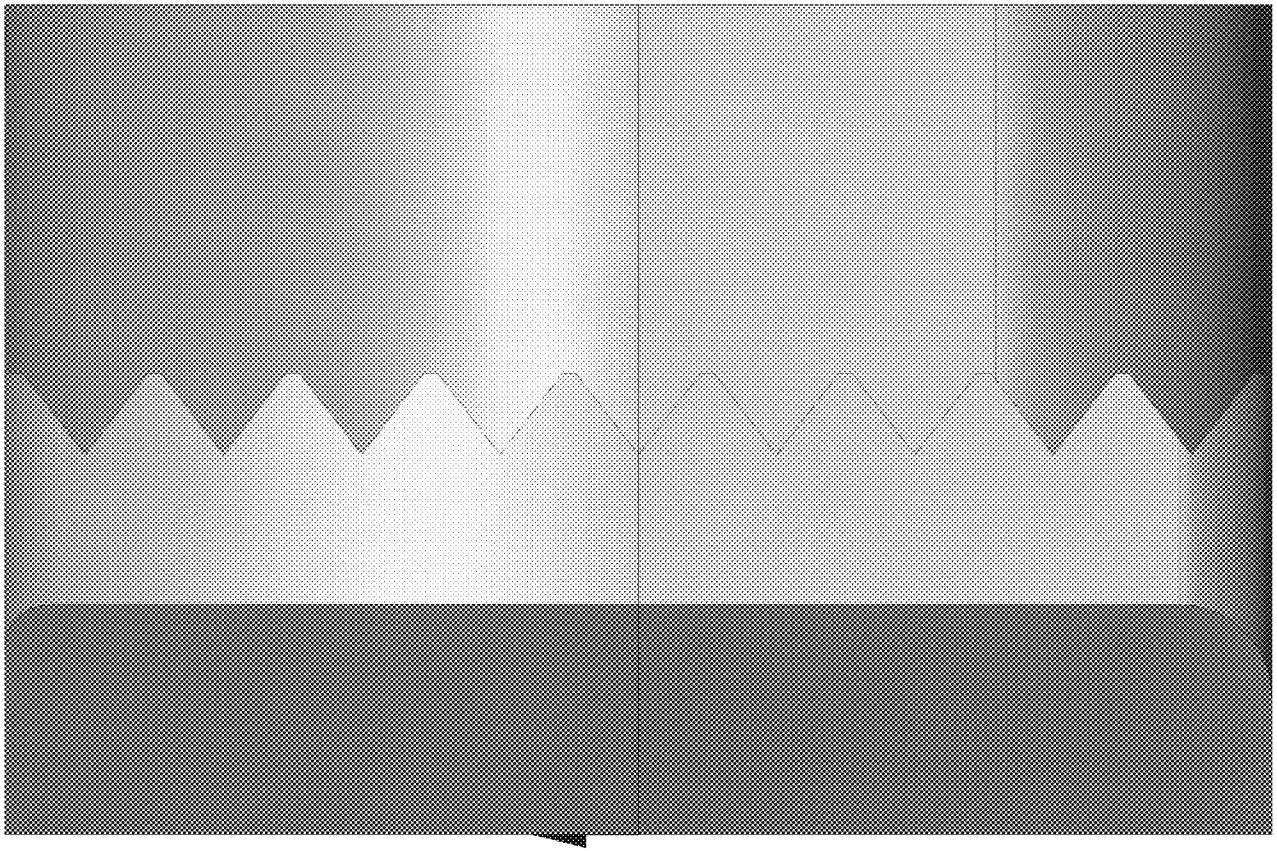
FIG. 45 is a front elevation view of the second fastener of FIG. 42.
Figure 46:
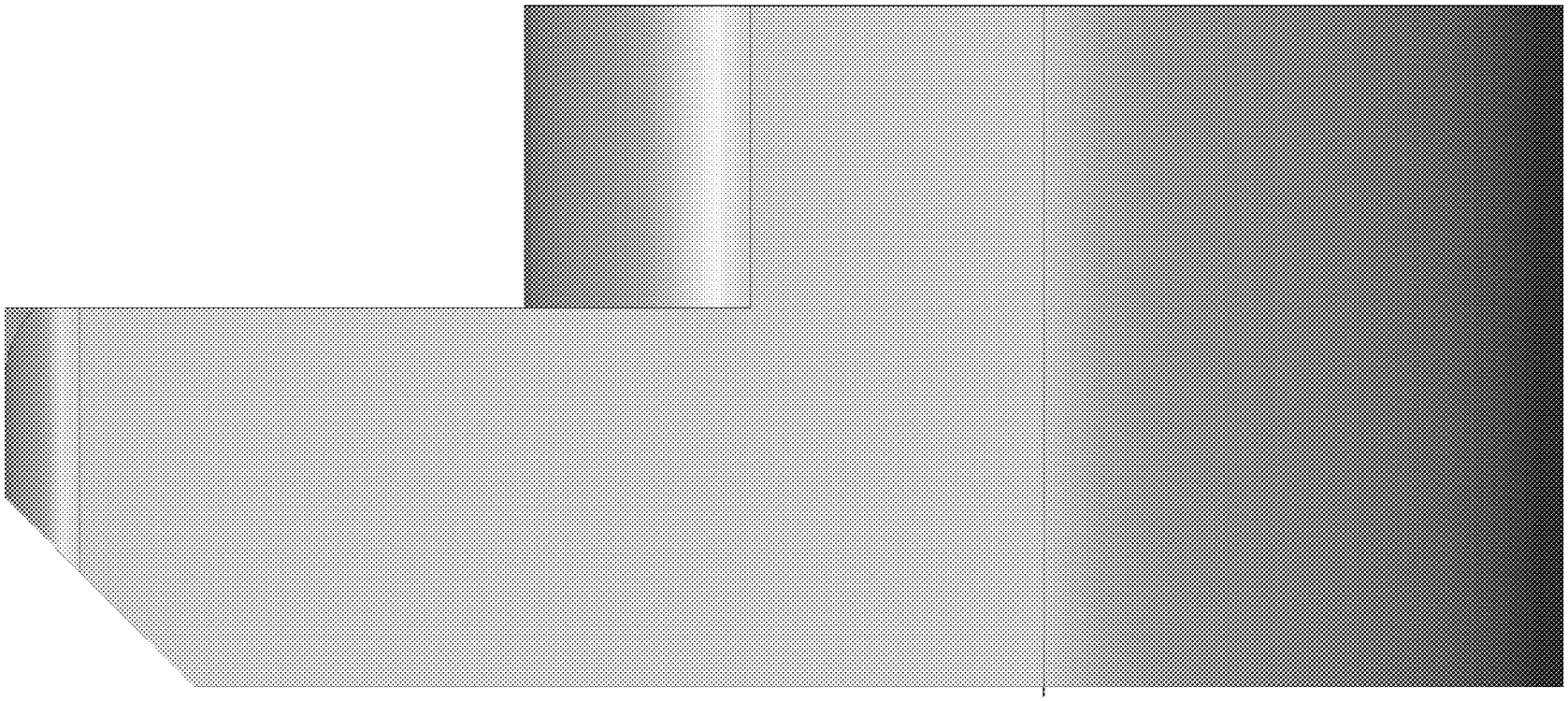
FIG. 46 is a side elevation view of the second fastener of FIG. 42.
Figure 47:
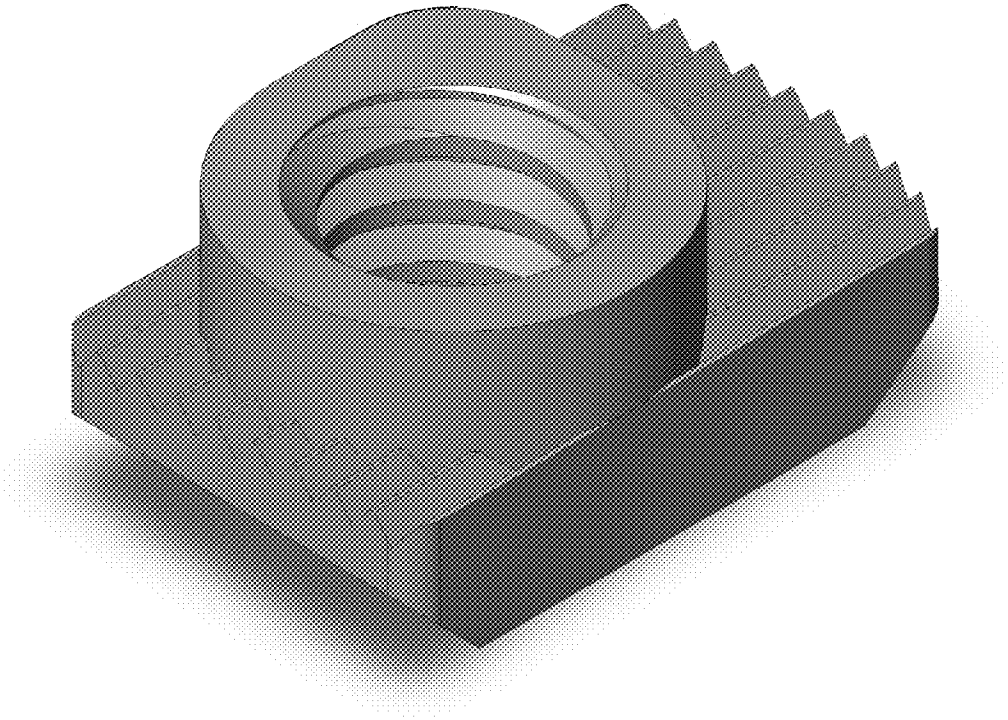
FIG. 47 is a perspective view of a second fastener according to an embodiment of this disclosure.
Figure 48:
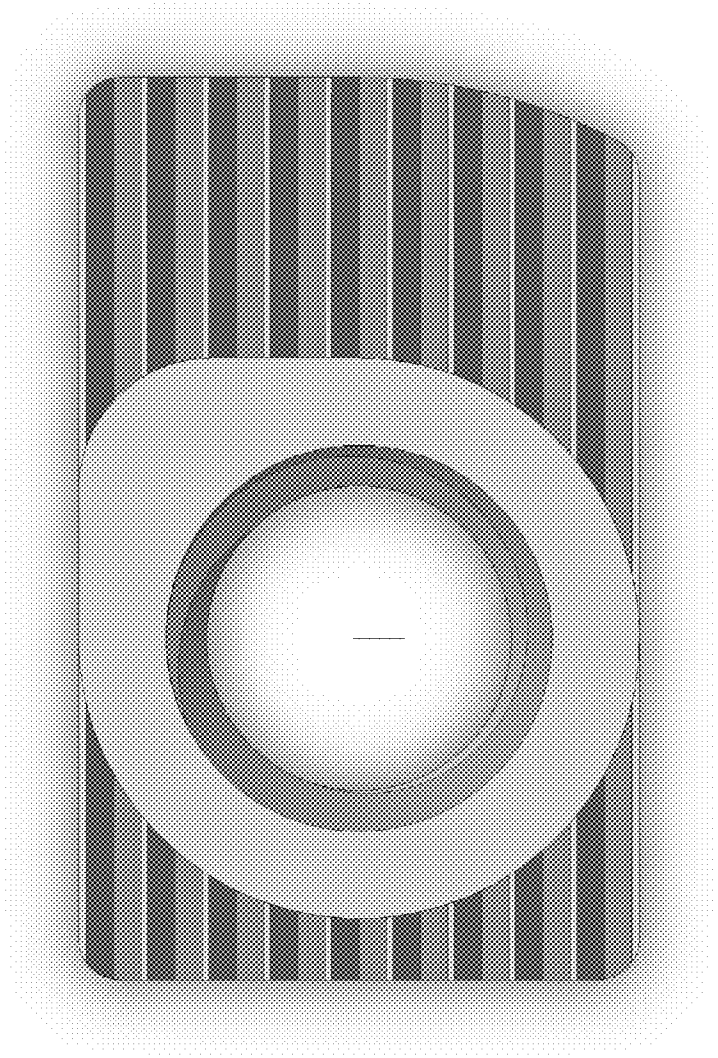
FIG. 48 is a top plan view of the second fastener of FIG. 47.
Figure 49:
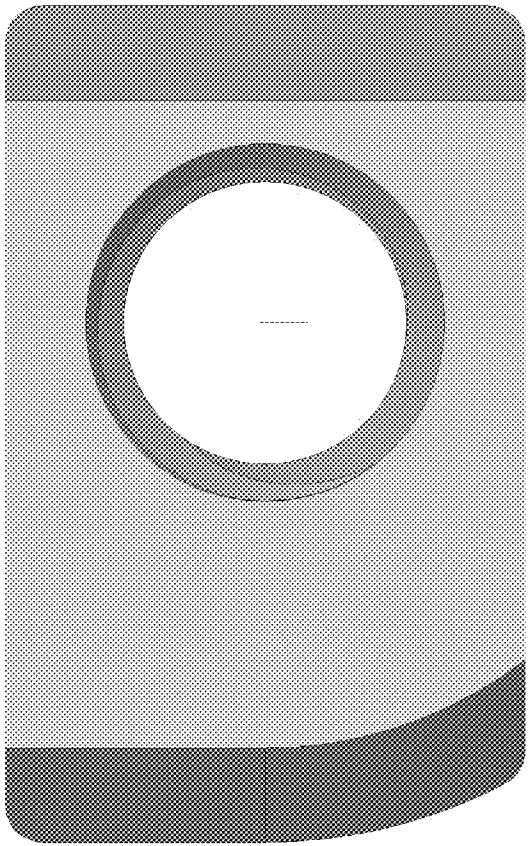
FIG. 49 is a bottom plan view of the second fastener of FIG. 47.
Figure 50:
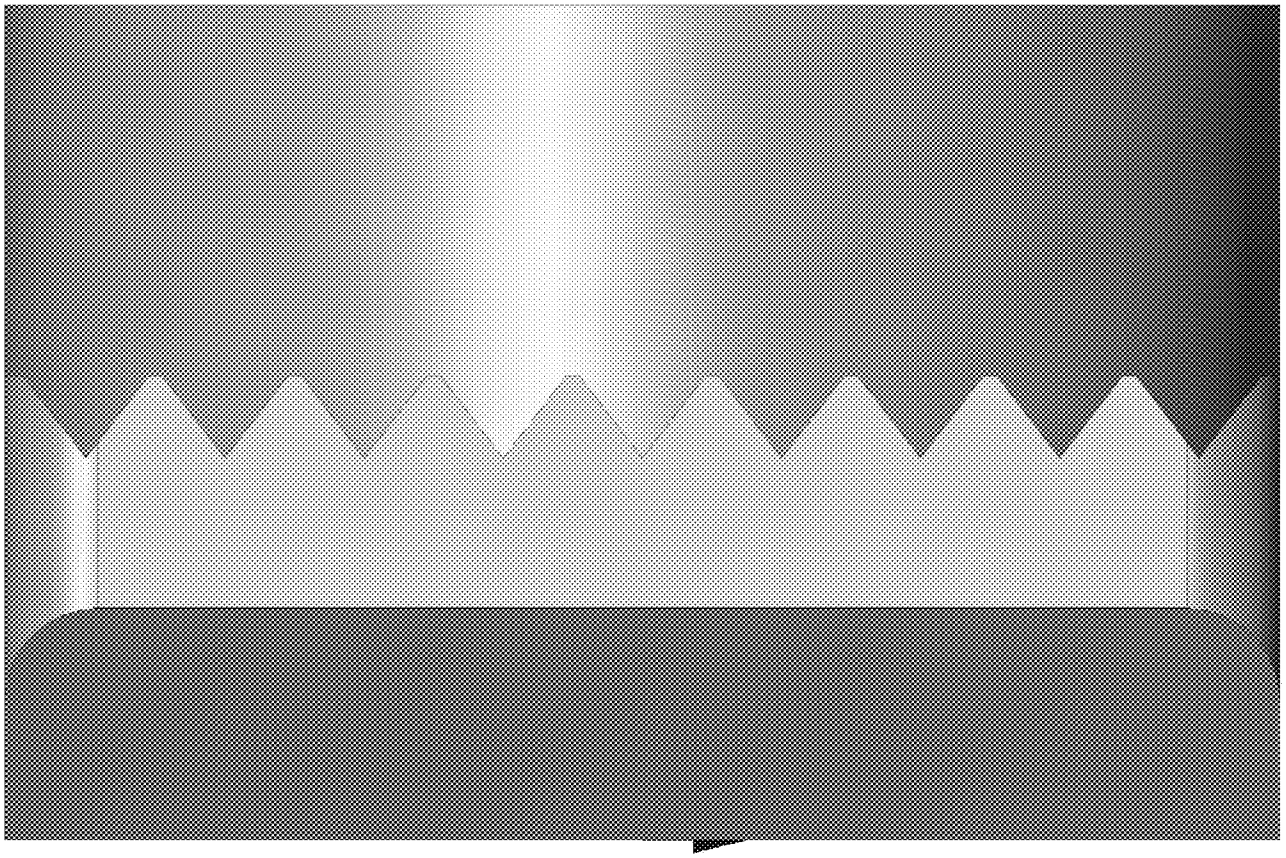
FIG. 50 is a front elevation view of the second fastener of FIG. 47.
Figure 51:
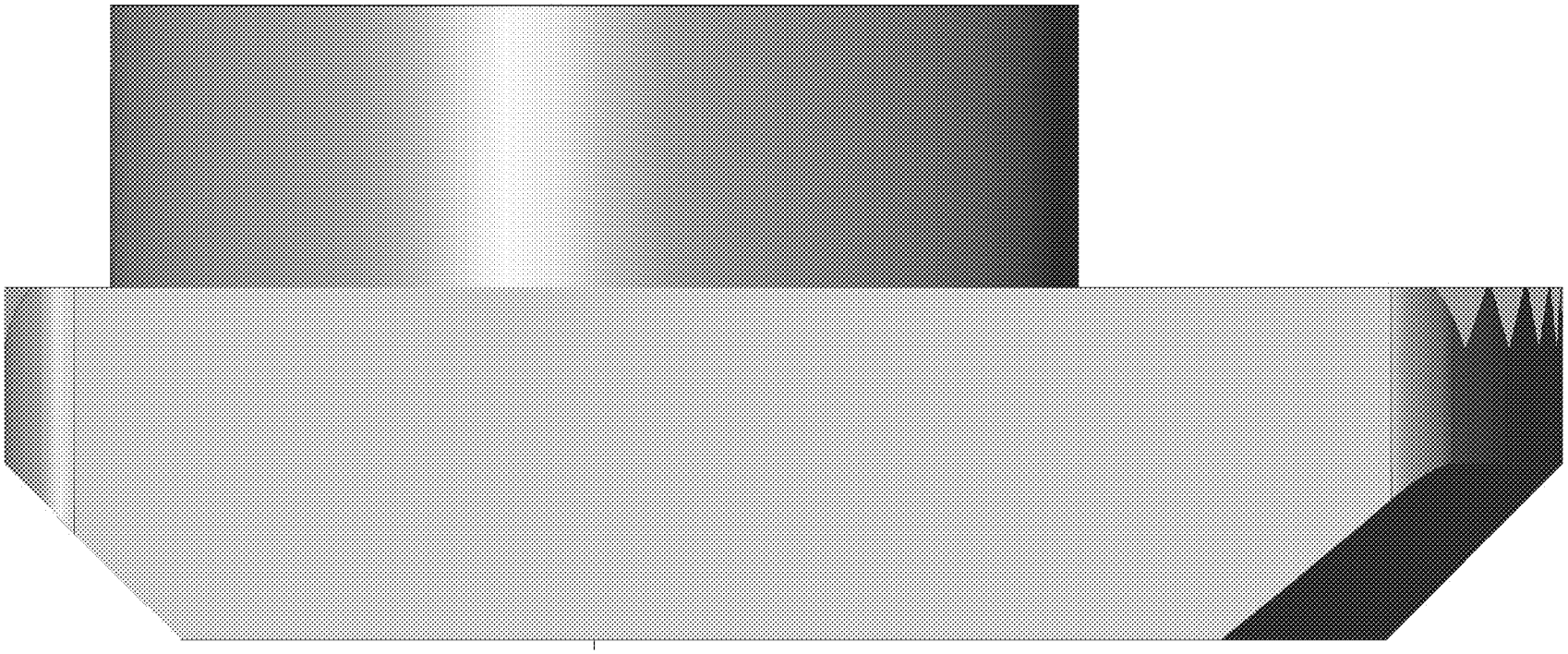
FIG. 51 is a side elevation view of the second fastener of FIG. 47.

The various embodiments of fasteners shown throughout the figures illustrates that the effect of the two curved or arced edges 1432, 1436 can be achieved with various radii of curvature, even those so small that they can be considered corners or sharp edges (e.g., FIG. 33-6). In some cases a single curved or arced edge can achieve the same effect as both of the curved or arced edges 1432, 1436 (e.g., FIGS. 42-51).

Returning to FIGS. 7-14B, the firearm accessory 810 is a modular Picatinny rail section that can be mounted to a firearm and then used to mount other accessories that can couple to the Picatinny rail section. Other firearm accessories, such as lights, scopes, laser sights, vertical grips, grenade launchers, and others can be mounted in similar fashion.

One or more second fasteners can be inserted and locked through a single elongated slot. When two or more complementary fasteners are inserted and mated through a single elongated slot, any number of the two or more complementary fasteners can be coupled to a single firearm accessory, or alternatively, multiple firearm accessories can be coupled to at least one of the two or more complementary fasteners that are inserted through a single elongated slot. In some embodiments, a single firearm accessory can mount via two or more elongated slots as illustrated in FIGS. 7-13.

The firearm itself can include any number of elongated slots 812, 814, 816 arranged in various locations on the firearm. For instance, elongated slots can be arranged on a handguard of a firearm as illustrated in FIGS. 1-6 and 20-21. The handguards illustrated in FIGS. 1-6 and 20-21 include three elongated slots on an upper left side of the handguards, three elongated slots on a right side of the handguards, and four elongated slots on a bottom of the handguards. Although these elongated slots are all of similar or identical size, in other embodiments, a plurality of elongated slots on a firearm can have one or more different lengths (the longer dimension of an elongated slot). The elongated slots may have a consistent or constant width (the smaller dimension of an elongated slot) such that a consistent size of second fastener can pass through all elongated slots and lock via a rotation of between 45° and 135°.

As illustrated throughout this disclosure, elongated slots can be arranged in rows such that the longer dimension of each elongated slot is aligned with the longer dimension of at least one other elongated slot. These arrangements of elongated slots can be referred to as rows of elongated slots. FIGS. 7-13 show an embodiment of a row of elongated slots and the handguards of FIGS. 1-6 and 20-21 have three rows of elongated slots.

The elongated slots not only function as mounting points, but also aid in dissipating heat from the barrel. The use of elongated slots as compared to Picatinny rails or KEYMOD apertures enables greater flexibility in positioning the firearm accessories than is possible in the prior art and is less complex to manufacture, more amenable to polymeric material manufacturing, can be formed more consistently and with tighter tolerances, and can be manufactured in less time. The elongated slots are also less likely to snag, actually decrease a weight of a firearm, and are comfortable to grip.

Figure 52A:
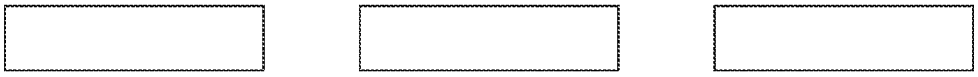
FIGS. 52A, 52B and 52C shows three different rows of elongated slots showing three different embodiments of elongated slot styles.
Figure 52B:
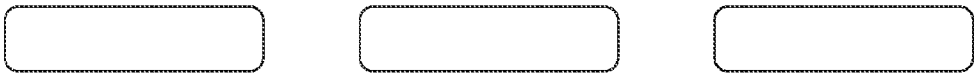
Figure 52C:
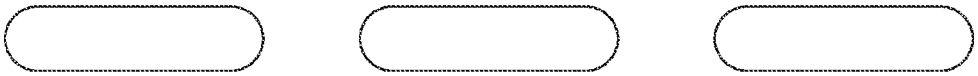

The elongated slots can take a number of different forms. For instance, FIGS. 52A, 52B and 52C illustrate three embodiments of elongated slots. FIG. 52(A) shows a row of elongated slots having square corners. FIGS. 52(B) and 52(C) show a row of elongated slots having beveled corners where the radius of curvature of these bevels is greater in FIG. 52(C). In FIG. 52(C) the radius of curvature is so great that the elongated slots can be described as each having semicircular ends. If one or more slot protrusions are used on a firearm accessory, each slot protrusion can have opposing beveled edges that are beveled or shaped to match the corners or ends of the elongated slots. For instance, if the elongated slot has beveled corners, then the slot protrusions (e.g., 820, 822, 824) may also have the same or a slightly smaller beveled radius. This can be seen in FIGS. 8, 9 and 23 where the slot protrusions 820, 824, 920, 924, 2300 appear to fit flush with beveled corners of an elongated slot 2320 or elongated slots 814, 816, 914, 916.

Figure 22:
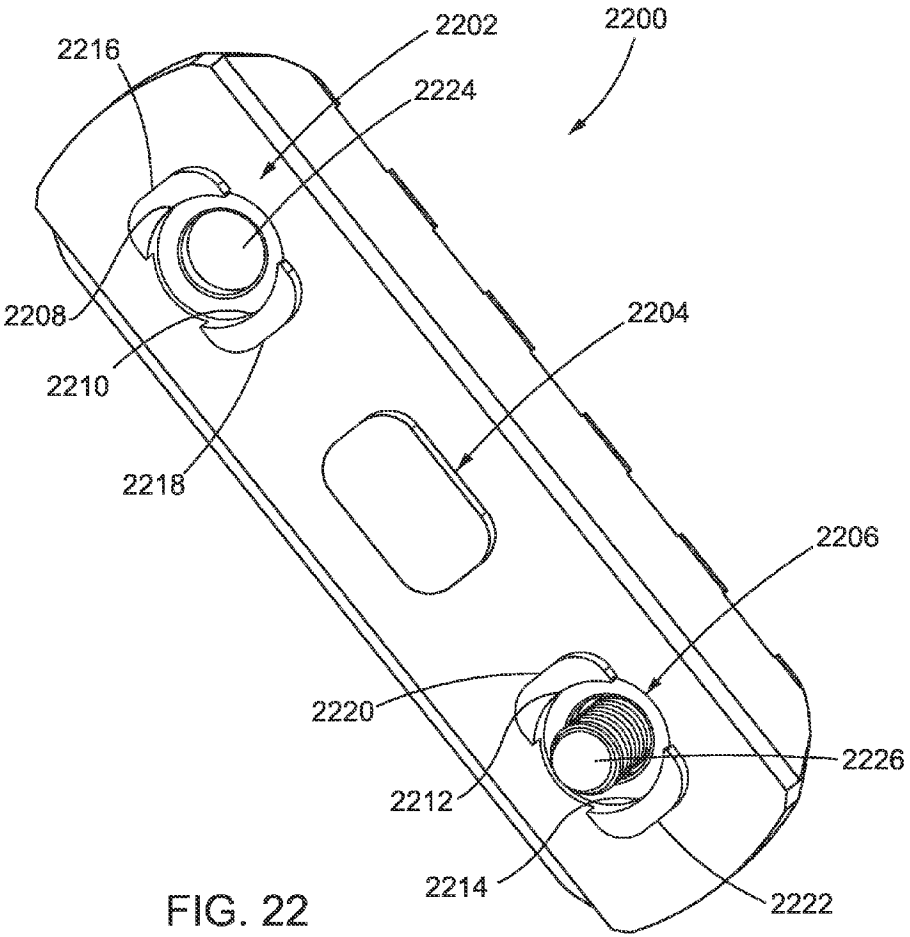
FIG. 22 is a bottom perspective view of a firearm accessory having three slot protrusions.
Figure 23A:
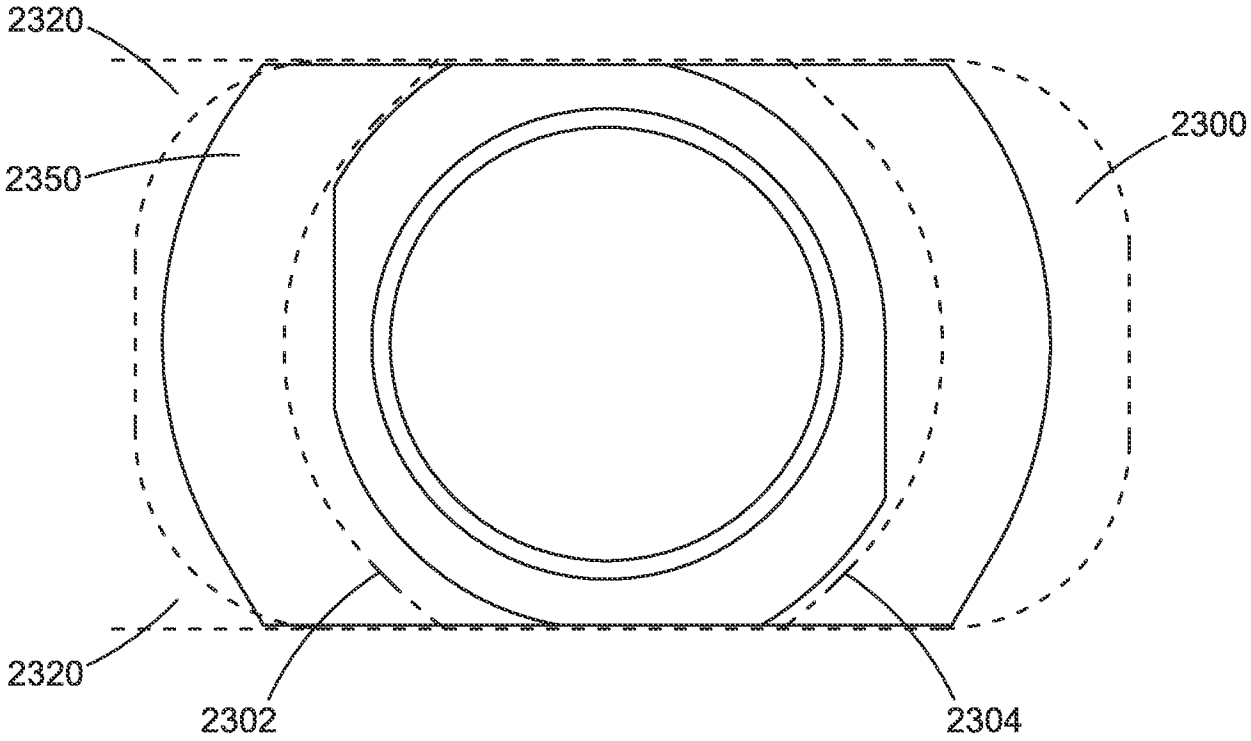
FIGS. 23A and B show two top views of an embodiment of a second fastener relative to an elongated slot and further relative to a slot protrusion, for an open and closed position of the second fastener.
Figure 23B:
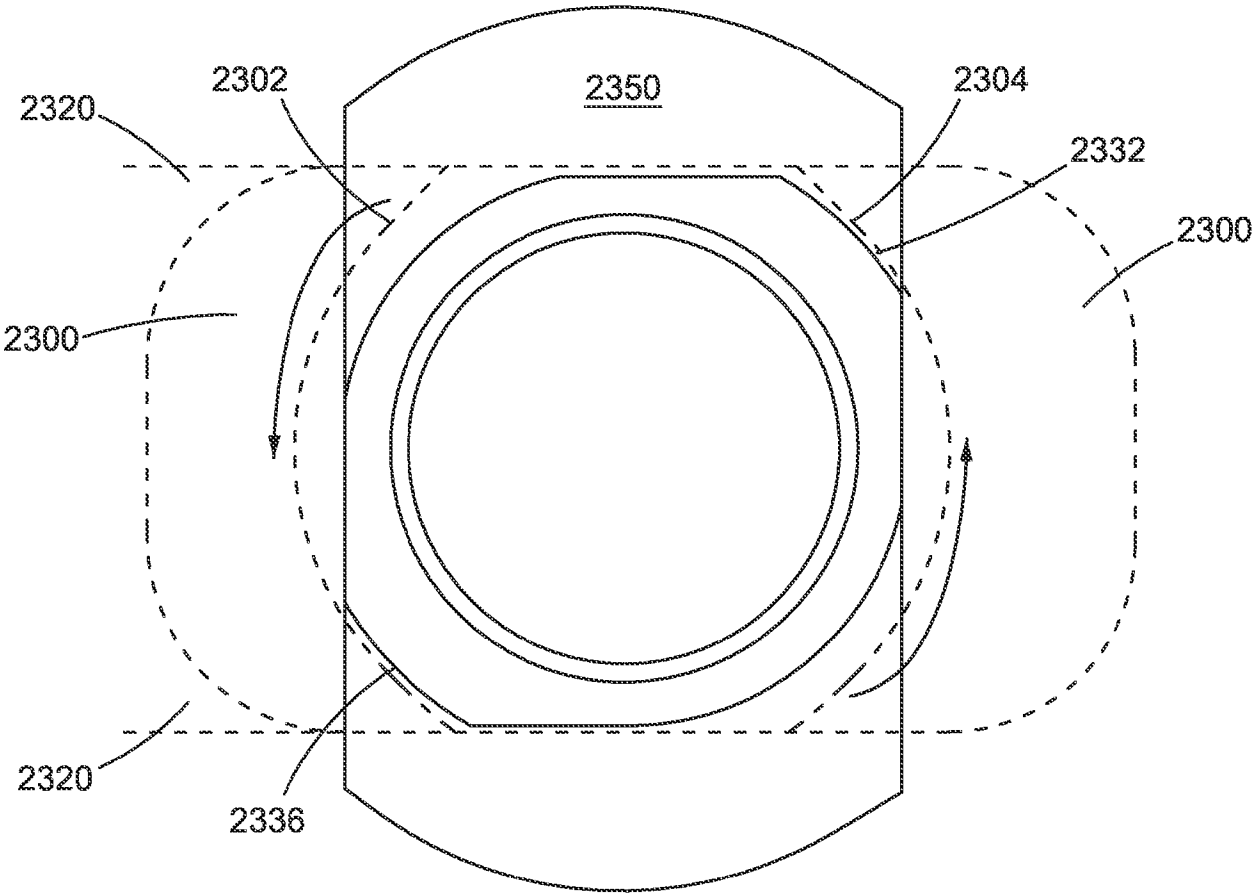
Figure 24:
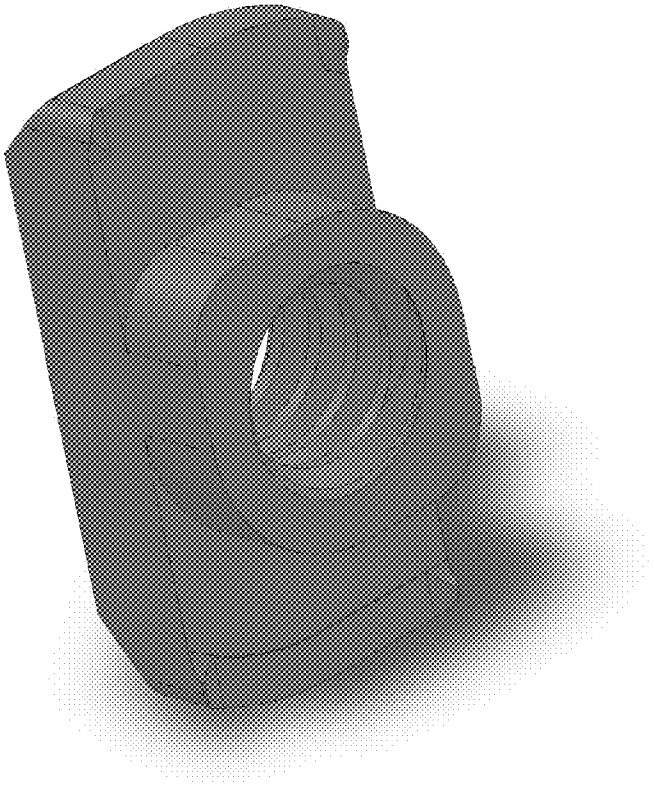
FIG. 24 is a perspective view of a second fastener according to an embodiment of this disclosure.
Figure 25:
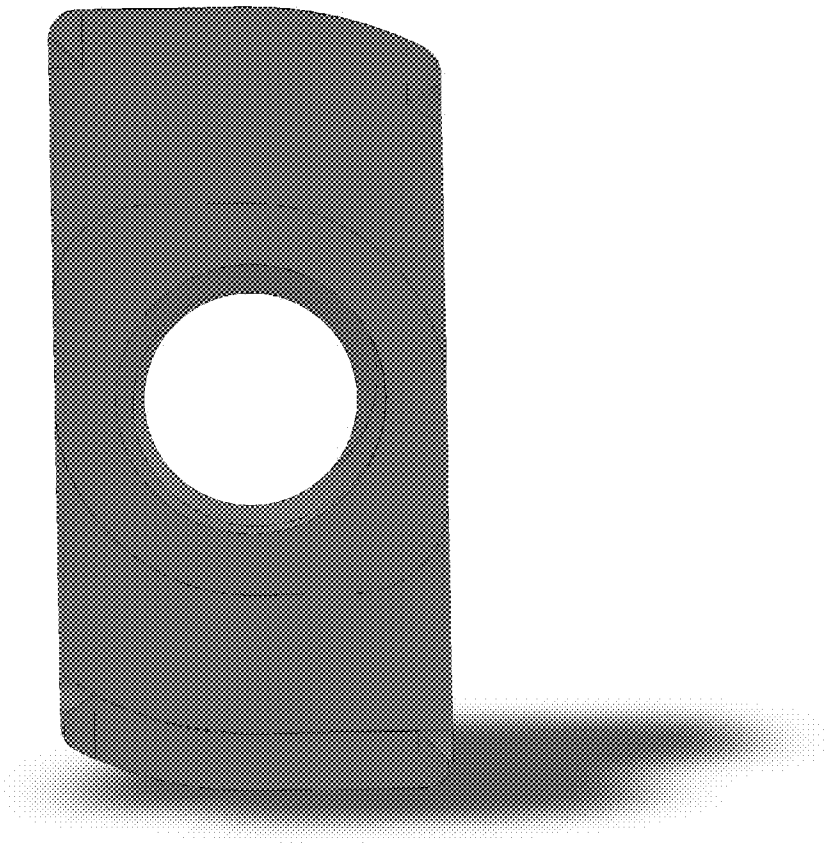
FIG. 25 is a top plan view of the second fastener of FIG. 24.
Figure 26:
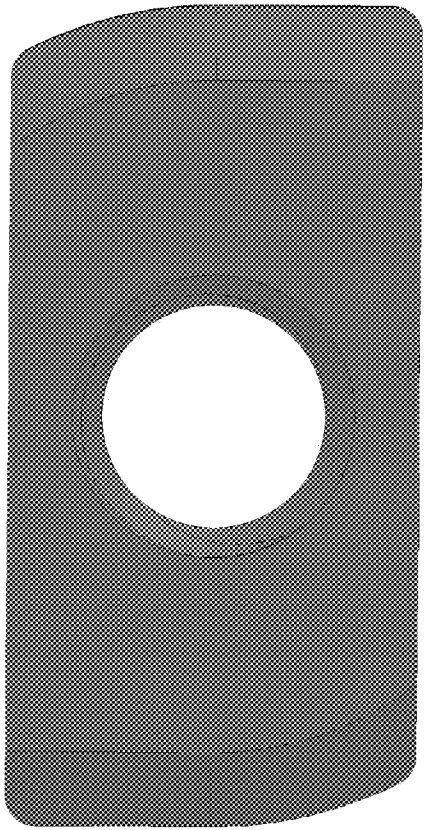
FIG. 26 is a bottom plan view of the second fastener of FIG. 24.
Figure 27:
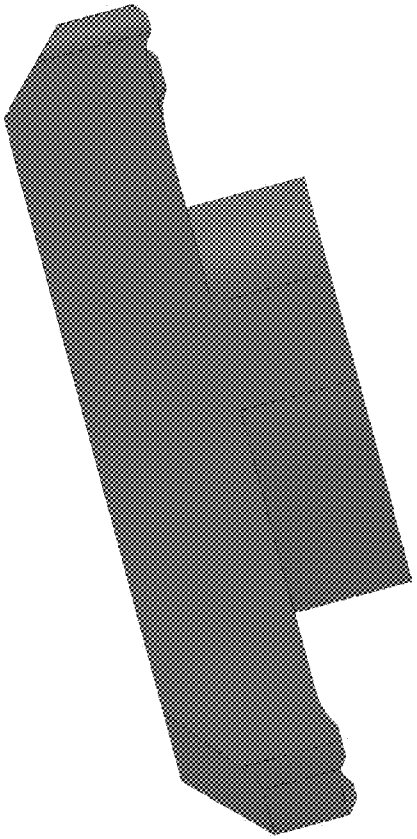
FIG. 27 is a side elevation view of the second fastener of FIG. 24.

FIG. 22 illustrates an embodiment of slot protrusions 2202, 2204, 2206 extending from a bottom of a firearm accessory 2200. Slot protrusions can also be seen in FIGS. 8, 9, 11, and 23. A slot protrusion is an extension of the firearm accessory, sometimes surrounding a through-hole for a first elongated fastener that fits into an elongated slot and surrounds an upper locking portion of a second fastener. A slot protrusion has a width that is the same or slightly smaller than a width of an elongated slot thus enabling the slot protrusion to fit into an elongated slot but preventing the firearm accessory from rotating (even before the first elongated fastener and the second fastener are coupled, let alone tightened). A slot protrusion can have four beveled corners such that the slot protrusion can fit snuggly against an end of an elongated slot, where the elongated slot also has beveled corners. As such, the radius of curvature of the beveled corners of the slot protrusion can be the same or slightly smaller than a radius of curvature of the beveled corners of the elongated slots. The illustrated slot protrusions 2202, 2204 can each be split into a first and second half, each half having an inner arc 2208, 2210, 2212, 2214 and beveled ends 2216, 2218, 2220, 2222. Each inner arc 2208, 2210, 2212, 2214 can be symmetric and have the same radius of curvature. As illustrated, the radius of curvature of the inner arcs 2208, 2210, 2212, 2214 is greater than half a width of the elongated slot 2620 and as seen in FIG. 23, is designed to match or create a substantially flush fit with the curved or arced edges 2332, 2336 of the upper locking portion 2350 of the second fastener 2300. Further, the radius of curvature of the inner arcs 2208, 2210, 2212, 2214 (2302, 2304 in FIG. 23A and FIG. 23B) can be equal to or slightly greater than a radius of curvature of the curved or arced edges 2332, 2336 of an upper locking portion of the second fastener 2350. This enables the second fastener 2350 to rotate such that the upper locking portion does not impinge on the first and third slot protrusions 2202, 2206. The second slot protrusion 2204 does not include inner arcs and instead is a solid rectangular shape having beveled corners. The first and third slot protrusions 2202, 2206 are arranged around through-holes, such as through-hole 2224, and are sized to allow a first elongated fastener (e.g., 2226) to pass through the through-holes.

FIGS. 24-27 show various views of an embodiment of a second fastener (e.g., a nut) and FIG. 28 shows a view of the second fastener with a first elongated fastener (e.g., a screw). The second fastener includes flanges and a raised locking portion similarly to prior embodiments described herein. However, a top surface of the flanges includes sharp protrusions extending up from each of four corners of a top surface of the flanges. The two flanges are asymmetric with each having opposite ends comprising a straight edge and a curved corner. This embodiment also include chamfers on a bottom outer edge of the flanges as best seen in the side elevation of FIG. 27. Other variations of the second fastener can be seen in FIGS. 29-51.

While this disclosure has been described primarily relative to a first elongated fastener and a second fastener, in other embodiments, various alternative complementary fasteners can be implemented. For instance, cammed fasteners (e.g., threaded fasteners) can be used.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An accessory mounting interface for a firearm, the interface comprising:

a firearm accessory having at least one through hole extending from a first surface to a second surface of the firearm accessory;

a first elongated fastener removably engaged in the through hole and having a first end extending below the second surface of the firearm accessory;

a second fastener rotationally mated to the first end of the first elongated fastener and having a length greater than a width of the second fastener, the length measured along a longitudinal axis of the second fastener, the second fastener comprising:

two straight edges parallel to each other; and a curved portion separating the two straight edges;

an elongated slot in a firearm having a length greater than a width of the elongated slot, and wherein the width is greater than the width of the second fastener but less than the length of the second fastener, such that the second fastener can pass through the elongated slot when the longitudinal axis of the second fastener is arranged parallel to a longitudinal axis of the elongated slot, but cannot pass through the elongated slot when the longitudinal axis of the second fastener is arranged obliquely to the longitudinal axis of the elongated slot, at least one of the two straight edges preventing the second fastener from rotating beyond a closed position once the second fastener has passed through and cleared the elongated slot.

2. The accessory mounting interface of claim 1, wherein the closed position is rotated 45° to 135° from an open position and wherein the longitudinal axis of the second fastener is parallel to the longitudinal axis of the elongated slot when the second fastener is in the open position.

3. The accessory mounting interface of claim 2, wherein the closed position is rotated 90° from the open position.

4. The accessory mounting interface of claim 1, wherein at least two straight edges of the second fastener are parallel to the longitudinal axis of the second fastener.

5. The accessory mounting interface of claim 4, wherein the second fastener has one or more curved portions having a radius of curvature centered at a center of the second fastener.

6. The accessory mounting interface of claim 5, wherein the radius of curvature of the one or more curved portions are equal to one half the width of the second fastener.

7. The accessory mounting interface of claim 1, wherein the first elongated fastener and the second fastener are cammed and mate via rotation of at least one of the first and second fasteners.

8. The accessory mounting interface of claim 7, wherein the first elongated fastener and the second fastener are threaded and mate via rotation of at least one of the first and second fasteners.

9. The accessory mounting interface of claim 1, wherein the elongated slot is part of a handguard of the firearm.

10. The accessory mounting interface of claim 1, wherein the firearm accessory is a rail for mounting other firearm accessories.

11. The accessory mounting interface of claim 1, wherein the firearm accessory is a sighting device.

12. The accessory mounting interface of claim 1, wherein the firearm accessory is a lighting device.

13. A method of mating a firearm accessory to a firearm having an accessory mounting interface, the method comprising:

providing a firearm accessory having a through hole;

providing a first elongated fastener removably engaged in the through hole and having a threaded region and a flanged end;

providing a second fastener, the second fastener comprising at least two straight edges, wherein one of the straight edges prevents the second fastener from rotating more than 45° to 135° relative to the longitudinal axis of the elongated slot;

mating the second fastener to the threaded region of the first elongated fastener;

providing an elongated slot in a wall of a firearm;

orienting a longitudinal axis of the second fastener parallel to a longitudinal axis of the elongated slot and passing the second fastener through the elongated slot;

rotating the first elongated fastener, which in turn rotates the second fastener, once the second fastener is clear of the elongated slot, such that the longitudinal axis of the second fastener rotates to an oblique orientation of between 45° to 135° relative to the longitudinal axis of the elongated slot and cannot rotate further, the rotating continuing after the second fastener cannot rotate further thereby drawing the flanged end of the first elongated fastener closer to the second fastener and preventing the second fastener from passing back through the elongated slot and also securing the firearm accessory to the firearm.

14. The method of claim 13, wherein the second fastener cannot rotate more than 90° from a position in which the longitudinal axis of the second fastener is parallel to the longitudinal axis of the elongated slot.

15. The method of claim 13, wherein the at least one of the straight edges prevents the second fastener from rotating more than 90° relative to the longitudinal axis of the elongated slot.

16. The method of claim 13, wherein the wall of the firearm is part of a handguard of the firearm.

17. A firearm accessory mounting interface comprising:

an elongated slot in a handguard of the firearm;

a first cammed fastener having:

a length sufficient to pass through the firearm accessory and clear a depth of a wall of the handguard; an a flanged head to press the firearm accessory against an outside of the handguard;

a second cammed fastener having a length greater than a width and being mated to the first cammed fastener and oriented so as to have a longitudinal axis parallel to a longitudinal axis of the elongated slot when inserted into and passed through the elongated slot and rotated 45° to 135° in order to prevent removal of the second cammed fastener from the elongated slot while the first cammed fastener is rotated such that the second cammed fastener and the flanged head of the first cammed fastener are drawn together thereby locking the firearm accessory to the handguard, the second cammed fastener having two parallel straight edges, one of the two parallel straight edges preventing the second cammed fastener from rotating more than 45° to 135° clockwise or counter-clockwise.

18. The firearm accessory mounting interface of claim 17, wherein the first cammed fastener and the second cammed fastener are threaded and mate via one of the first and second fasteners rotating relative to the other fastener.

19. The firearm accessory mounting interface of claim 17, wherein one of the two parallel straight edges of the second cammed fastener prevents the second cammed fastener from rotating more than 90° relative to the longitudinal axis of the elongated slot.

20. The accessory mounting interface of claim 17, wherein the two parallel straight edges of the second cammed fastener are parallel to the longitudinal axis of the second fastener.

21. The accessory mounting interface of claim 20, wherein the second cammed fastener has one or more curved portions having a radius of curvature centered at a center of the second cammed fastener.

22. The accessory mounting interface of claim 21, wherein the radius of curvature of the one or more curved portions are equal to one half the width of the second cammed fastener.

23. The accessory mounting interface of claim 17, wherein the firearm accessory is a rail for mounting other firearm accessories.

24. The accessory mounting interface of claim 17, wherein the firearm accessory is a sighting device.

25. The accessory mounting interface of claim 17, wherein the firearm accessory is a lighting device.

* * * * *